US007255896B2

(12) United States Patent
Kawabe

(10) Patent No.: US 7,255,896 B2
(45) Date of Patent: Aug. 14, 2007

(54) PRODUCING METHOD FOR DIE COATER AND COATING APPARATUS

(75) Inventor: Shigetoshi Kawabe, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/846,751

(22) Filed: May 13, 2004

(65) Prior Publication Data

US 2005/0037145 A1 Feb. 17, 2005

(30) Foreign Application Priority Data

May 21, 2003 (JP) ..... 2003-143358

(51) Int. Cl.
*B05D 3/02* (2006.01)
*B05D 3/00* (2006.01)
*B24B 1/00* (2006.01)

(52) U.S. Cl. ..... 427/318; 427/327; 427/290; 451/55

(58) Field of Classification Search ..... 427/314, 427/318, 327, 299, 307, 385, 385.5, 290, 427/355, 424; 118/125; 72/340, 342.1; 29/DIG. 10, DIG. 19; 451/54, 55; 425/461; 164/291
See application file for complete search history.

(56) References Cited

U.S. PATENT DOCUMENTS 4,001,053 A * 1/1977 Igisu ..... 148/558
4,659,598 A * 4/1987 Traut ..... 428/36.4
5,635,002 A * 6/1997 Oikawa et al. ..... 156/196
6,133,359 A * 10/2000 Bate et al. ..... 524/430
6,214,114 B1 * 4/2001 Kawabe et al. ..... 118/325
2002/0050662 A1 * 5/2002 Kawabe ..... 264/172.19

FOREIGN PATENT DOCUMENTS

JP 4162950 * 6/1992
JP 11-156265 A 6/1999
JP 2001-191004 A 7/2001
JP 2001-269606 A 10/2001
JP 2001-276709 A 10/2001

* cited by examiner

*Primary Examiner*—Timothy Meeks
*Assistant Examiner*—David Turocy
(74) *Attorney, Agent, or Firm*—Frishauf, Holtz, Goodman & Chick, P.C.

(57) ABSTRACT

A method of producing a die coater structured with at least two bars so as to form a pocket section to extend a coating liquid in a coating width direction, a coating liquid supply port to supply a coating liquid to the pocket section, and a slit section to discharge a coating liquid from the pocket section to a material to be coated, wherein at least a part of a surface of the two bars coming in contact with a coating liquid is covered with a fluorine-based resin, the method comprises steps of: a preheating step of conducting a preheating process for a bar with a preheating temperature higher than a baking temperature in a baking process in a covering step of a fluorine-based resin; a grinding step of grinding the bar subjected to the preliminary heating process; and the covering process of covering a part of a surface of the bar with a fluorine-based resin so as to form a covered section, wherein the surface of the bar was subjected to the grinding step and comes in contact with a coating liquid.

14 Claims, 8 Drawing Sheets

FIG. 2 ( a )
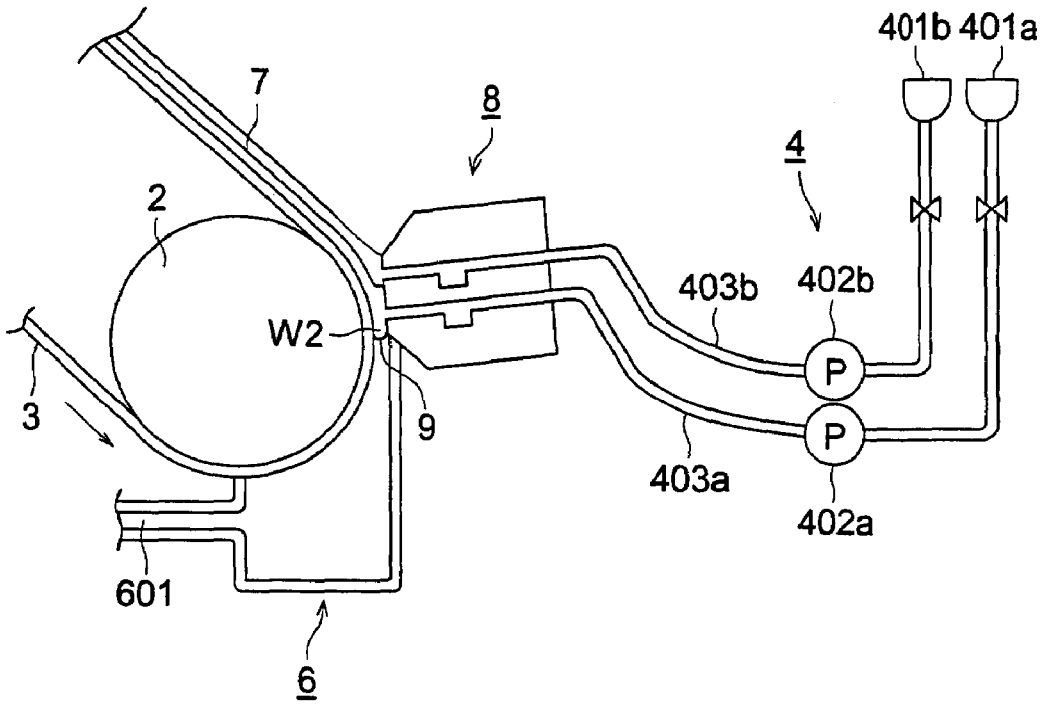
FIG. 2 ( b )
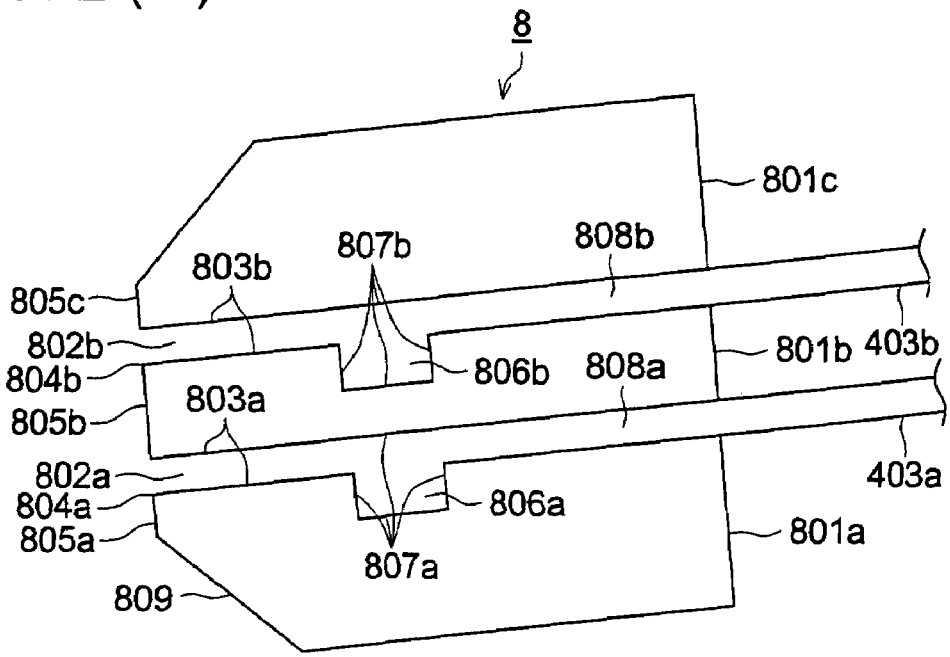

PRODUCING METHOD FOR DIE COATER AND COATING APPARATUS

BACKGROUND OF THE INVENTION

The present invention relates to a coating apparatus provided with a die coater having at least 2 bars mounted thereon and to a method of producing the die coater, and specifically, relates to a coating apparatus provided with a die coater having at least 2 bars with an excellent cleanability mounted thereon and to a method of producing the die coater having at least 2 bars mounted thereon, wherein the coating apparatus causes few coating failures and achieves an excellent coating quality.

In the prior art, as a method for coating a continuously running belt-shaped support (hereinafter, also referred to as 'support') with a liquid coating composition (for example, liquid coating compositions for subbing, overcoating, and a backside layer) for surface treatment of materials such as photographic photosensitive materials, heat development recording materials, abrasion recording materials, magnetic recording media, glass plates, steel plate, etc., there are known methods such as dip coating methods, blade coating methods, air knife coating methods, wire bar coating methods, gravure coating methods, reverse coating methods, reverse roll coating methods, extrusion coating methods, slide coating methods, and curtain coating methods.

Among these, slide coating methods, extrusion coating methods, and curtain coating methods allow high speed coating, thin layer coating, and simultaneous multi-layer coating, and accordingly, are widely used in coating photographic photosensitive materials, heat development recording materials, and abrasion recording materials. Serving as coating apparatuses to be used in these coating methods, there are used slide type die coaters for slide coating methods, extrusion type die coaters for extrusion coating methods, and curtain type die coaters for curtain coating methods.

These die coaters are produced having at least two bars mounted thereon, and regarding the structure of the die coaters, in the case of a slide type die coater, for example, the die coater has at least 2 bars and is comprised of a slit section that is constructed of at least 2 bars and lets a liquid coating composition flow out, a pocket section for supplying the liquid coating composition uniformly in the lateral direction of the slit section, a sliding section on which the liquid coating composition having flowed out of the slit section flows, and a lip section for forming beads between the end of the sliding section and a support to coat the support with the beads of the liquid coating composition. The slit section, the pocket section, the sliding section, the lip section, and an outer wall that is continuous with the lip section, are portions that come in contact with the liquid coating composition.

As for performing coating of a liquid coating composition for a photographic photosensitive material containing silver halide grains or a heat development recording material by the use of a slide type die coater, an extrusion type die coater, or a curtain type die coater, it is known that a portion, of the various die coaters, which comes in contact with the liquid coating composition has the following problem.

Regarding an outer wall continuous with a lip section, when a flow rate is set at the start of coating and when coating is terminated, a liquid coating composition flows down along the outer wall continuous with the lip section, adheres to the outer wall, and then gets dry and solidifies, which makes cleaning after the termination of coating painstaking.

Tiny foreign materials and silver halide grains may adhere to the slit section, the pocket section, the sliding section, and the lip section. In the course of coating for a long time, tiny foreign materials and silver halide grains adhering to these sections turn into a core, then further foreign materials and silver halide grains adhere to the core, and thus such created an adhering deposit may grow. If the deposit grows to a certain extent in this way, the rate and the flow speed of a liquid coating composition vary at the deposit, which makes the flow of the liquid coating composition unstable, resulting in a coating failure and difficulty in production. It is understood that these foreign materials and silver halide grains appear, for example, in such a way that foreign materials adhering to dead spaces of joint sections and valves of pipes which are disposed in a complex liquid coating composition supply system extending from a liquid coating composition supply pipe to the exit of a slit section of a die coater are torn off by conveying the liquid coating composition, and silver halide deposits in the liquid coating composition to become grains in the course of coating of the liquid coating composition for a long time. Particularly, at a start of coating, a liquid coating composition is rapidly conveyed into a liquid coating composition supply system, which tears off tiny foreign materials adhering to the respective dead spaces of the liquid coating composition supply system, and then the foreign materials adhere to portions of the die coater where the die coater contacts with the liquid coating composition.

For coating for a long time, there are known the following solutions that prevent silver halide grains deposited in a liquid coating composition and tiny foreign materials from adhering to portions, of a die coater, which contact with the liquid coating composition, and allow stable coating and easy cleaning after termination of coating.

For example, there is known a technology in which a pocket section, a slit section, etc. of an extrusion type die coater are formed with a fluorine based resin so that cleaning and disassembling are easy (referring to Patent Documents 1 and 2, for example). Another technology is known in which the periphery of a slit section of an extrusion type die coater is lyophilized with a fluorine based resin to allow forming of a thin layer without a streak type unevenness (referring to Patent Document 3, for example). Still another technology is known in which the outer wall side surface of an extrusion type coater for coating base materials is covered with a fluorine based resin to prevent retention of a liquid coating composition at a start of coating and to achieve uniform layer thickness (referring to Patent Document 4, for example).

The technologies disclosed in the above stated Patent Documents 1 to 4 are so sophisticated as to allow it to prevent adherence of foreign materials by covering portions of a die coater, the portions coming in contact with a liquid coating composition, with a fluorine based resin, but these technologies have the following problem.

Usually, a die coater covered with a fluorine based resin at portions coming in contact with a liquid coating composition is produced through the following processes in brief. Bars that are components of the die coater are subjected to either sweeping treatment for cleaning of portions to be covered with the fluorine based resin or a heat treatment called 'pre-idle heating', and a heat treatment called 'baking' for sticking the fluorine based resin to a base material, thereafter the bars are subjected to grinding and polishing, and then at least two such bars are mounted to produce the die coater.

In a process of covering bars with a fluorine based resin, these heat treatments deteriorate the straightness of the bars, and when a die coater is produced having these bars mounted thereon, the gap of a slit section in the lateral direction of coating and the distance between the die coater and an object to be coated become uneven to lower the uniformity of thickness of a layer in the lateral direction of coating, which may have resulted in a fear that coating cannot be achieved.

As a coating layer thickness is required to be accurate, the straightness of a die coater is also required to have an accuracy of a few micrometers. In covering a bar with a fluorine based resin, if the bar has a coating width shorter than 1 m approximately, the influence of heat treatment in a resin covering process is negligible and will not be a problem. However, in the case of a bar used for a die coater having a coating width exceeding 1 m, the influence of heat treatment in a fluorine based resin covering process is so significant that although a die coater produced having bars covered with the fluorine based resin is allowed to prevent coating failures due to deposition of a liquid coating composition, but the die-coater is not allowed to attain uniformity of layer thickness in the lateral direction of coating, thus only permitting coating that does not require a quality with uniformity of the coating layer thickness.

[Patent Document 1]
TOKKAI No. H11-156265
[Patent Document 2]
TOKKAI No. 2001-269606
[Patent Document 3]
TOKKAI No. 2001-191004
[Patent Document 4]
TOKKAI No. 2001-276709

SUMMARY OF THE INVENTION

With the background stated above, an object of the invention is to provide a coating apparatus using a die coater with a width of 1 meter or longer and a method of producing the die coater, the die coater having portions that come in contact with a liquid coating composition and have been subjected to covering with a fluorine based resin to achieve products that are coated with a uniform coating thickness in the lateral direction of coating and have few coating failures can be achieved.

The above-described object has been attained with the following items.

1) A coating apparatus comprising a pocket section for extending a liquid coating composition in the lateral direction of coating, a liquid coating composition supply inlet for supplying the liquid coating composition (coating liquid) to the pocket section, and a slit section for ejecting the liquid coating composition from the pocket section to an object to be coated, and employing a die coater having at least 2 bars mounted thereon, wherein at least one portion, of each bar, that forms a surface of the die coater and comes in contact with the liquid coating composition is covered with a fluorine based resin, and the straightness, in the lateral direction of coating, of the surface covered with the fluorine based resin of each bar ranges from 0.1 to 10 μm.

2) A coating apparatus comprising a pocket section for extending a liquid coating composition in the lateral direction of coating, a liquid coating composition supply inlet for supplying the liquid coating composition to the pocket section, and a slit section for ejecting the liquid coating composition from the pocket section to an object to be coated, and employing a die coater having at least 2 bars mounted thereon, wherein at least one portion, of each bar, that forms a surface of the die coater and comes in contact with the liquid coating composition is covered with a fluorine based resin, and the surface roughness of the fluorine based resin covered portion of each is within a range of 0.01 μm<Ra<1 μm and 0.1 μm<$R_{max}$<5 μm.

3) A coating apparatus comprising a pocket section for extending a liquid coating composition in the lateral direction of coating, a liquid coating composition supply inlet for supplying the liquid coating composition to the pocket section, and a slit section for ejecting the liquid coating composition from the pocket section to an object to be coated, and employing a die coater having at least 2 bars mounted thereon, wherein at least one portion, of each bar, that forms a surface of the die coater and comes in contact with the liquid coating composition is covered with a fluorine based resin, the surface roughness of the fluorine based resin covered portion of each bar is within a range of 0.01 μm<Ra<1 μm and 0.1 μm<$R_{max}$<5 μm, and the straightness of the fluorine based resin covered portion of the bar in the lateral direction of coating is within a range from 0.1 to 10 μm.

4) A coating apparatus comprising a pocket section for extending a liquid coating composition in the lateral direction of coating, a liquid coating composition supply inlet for supplying the liquid coating composition to the pocket section, and a slit section for ejecting the liquid coating composition from the pocket section to an object to be coated, and employing a die coater having at least 2 bars mounted thereon, wherein at least one portion, of each bar, that forms a surface of the die coater and comes in contact with the liquid coating composition is covered with a fluorine based resin, and the portion of the bar to be covered with the fluorine based resin is removed in advance by grinding for the thickness of the fluorine based resin cover prior to the fluorine based resin covering, and thereafter, covered with the fluorine based resin.

5) A coating apparatus comprising a pocket section for extending a liquid coating composition in the lateral direction of coating, a liquid coating composition supply inlet for supplying the liquid coating composition to the pocket section, and a slit section for ejecting the liquid coating composition from the pocket section to an object to be coated, and employing a die coater having at least 2 bars mounted thereon, wherein at least one portion, of each bar, that forms a surface of the die coater and comes in contact with the liquid coating composition is covered with a fluorine based resin, and the bars are subjected in advance to a thermal pretreatment at a temperature same as or higher than that of a heat treatment in a fluorine based resin covering process, thereafter to grinding, and then to covering with the fluorine based resin.

6) The coating apparatus according to item 5, wherein the grinding includes a first grinding for removing deformation caused by the thermal pretreatment and a second grinding for forming a final finish shape.

7) The coating apparatus according to item 5 or 6, wherein the bars are subjected to covering with the fluorine based resin, and thereafter to finish grinding.

8) The coating apparatus according to item 7, wherein the finish grinding makes the straightness of the surface of each portion covered with the fluorine based resin within a range from 0.1 to 10 μm.

9) The coating apparatus according to any one of items 5 to 8, wherein the bars are subjected to covering with the fluorine based resin, and thereafter to polishing on the surface of each portion subjected to the covering.

10) The coating apparatus according to any one of items 5 to 9, wherein the bars have a surface roughness of each portion subjected to the covering process within a range of 0.01 μm<Ra<1 μm and 0.1 μm<$R_{max}$<5 μm.

11) The coating apparatus according to any one of items 5 to 10, wherein the bars are subjected to the thermal pretreatment, thereafter each portion thereof to be covered with the fluorine based resin is removed in advance by grinding for the thickness of the fluorine based resin prior to the covering, and then covered with the fluorine based resin.

12) The coating apparatus according to any one of items 1 to 11, wherein the die coater is comprised of at least two bars; the gap of at least one slit section formed by the bars has an outlet narrower than an inlet of a liquid coating composition and the gap d at the outlet is $d \leqq 5\times10^{-5}$ [m]; and the bars are components of the die coater that ejects a liquid coating composition in a layer form from the slit section in order to make the liquid coating composition collide, at a predetermined gap, with an object to be coated for coating, the object being disposed or conveyed with no contact with the outlet of the slit section.

13) The coating apparatus according to any one of items 1 to 11, wherein the bars are structure members of an extrusion type die coater that extrudes the liquid coating composition from at least one slit section formed by at least 2 bars onto a belt-shaped support that is continuously conveyed from upstream to downstream, then forms beads of the liquid coating composition between the vicinity of a liquid coating composition extruding part of the lip section and the support, and coats the beads on the support.

14) The coating apparatus according to any one of items 1 to 11, wherein the bars are structure members of a slide type die coater that extrudes the liquid coating composition from at least one slit section formed by at least 2 of the bars onto a belt-shaped support that is continuously conveyed from upstream to downstream, lets the liquid coating composition having been extruded flow down along a steep which is continuous with the outlet of the slit, then forms beads of the liquid coating composition between the belt-shaped support and a vicinity of an end part of the steep, and coats the beads on the belt-shaped support.

15) The coating apparatus according to any one of items 1 to 11, wherein the bars are structure members of a curtain type die coater that lets the liquid coating composition having been extruded from at least one slit section formed by at least two of the bars fall freely onto a belt-shaped support that is continuously conveyed from upstream to downstream, and thereby coats the liquid coating composition.

16) The coating apparatus according to any one of items 1 to 15, wherein the bars are structure members of a die coater having a width of 1 meter or larger.

17) The coating apparatus according to any one of items 11 to 16, wherein the belt-shaped support is in a state that a surface opposite to a coated surface thereof is supported by a backroll.

18) The coating apparatus according to item 13, wherein the belt-shaped support is supported by a support roll at a position near the die coater.

19) The coating apparatus, according to any one of items 1 to 18, wherein the liquid coating composition is a liquid coating composition for a photosensitive layer containing a silver component for a heat-developing photosensitive material or a liquid coating composition for a non-photoreceptive protective layer.

20) A method of producing a die coater comprising a pocket section that extends a liquid coating composition in the lateral direction of coating, a liquid coating composition supply inlet for supplying the liquid coating composition to the pocket section, and a slit section that ejects the liquid coating composition from the pocket section to an object to be coated, the die coater having at least 2 bars mounted thereon, the bars having a surface coming in contact with the liquid coating composition and being components of the die coater and coated with a fluorine based resin at, at least, one portion of the surface, wherein the portion of each bar to be covered with the fluorine based resin is covered with the fluorine based resin for a thickness greater than the amount to be finish-grinded, then baked; and thereafter, the surface covered with the fluorine based resin is finish-grinded and/or polished to be finished with a straightness in the lateral direction of coating within a range from 0.1 to 10 μm and with a surface roughness of the portion having been subjected to covering with the fluorine based resin within a range of 0.01 μm<Ra<1 μm, and 0.1 μm<Rmax<5 μm.

21) A method of producing a die coater comprising a pocket section that extends a liquid coating composition in the lateral direction of coating, a liquid coating composition supply inlet for supplying the liquid coating composition to the pocket section, and a slit section that ejects the liquid coating composition from the pocket section to an object to be coated, the die coater having at least 2 bars mounted thereon, the bars having a surface coming in contact with the liquid coating composition and being coated with a fluorine based resin at, at least, one portion of the surface, wherein each bar is subjected in advance to a thermal pretreatment at a temperature same as or higher than that of a heat treatment of a covering process of the fluorine based resin and thereafter to grinding; a portion of each bar to be covered with the fluorine based resin is covered with the fluorine based resin for a thickness greater than the amount to be finish-grinded, then baked; and thereafter, the surface covered with the fluorine based resin is finish-grinded and/or polished to be finished with a straightness in the lateral direction of coating within a range from 0.1 to 10 μm and with a surface roughness of the portion having been subjected to covering with the fluorine based resin within a range of 0.01 μm<Ra<1 μm, and 0.1 μm<Rmax<5 μm.

22) A method of producing a die coater comprising a pocket section that extends a liquid coating composition in the lateral direction of coating, a liquid coating composition supply inlet for supplying the liquid coating composition to the pocket section, and a slit section that ejects the liquid coating composition from the pocket section to an object to be coated, the die coater having at least 2 bars mounted thereon, the bars having a surface coming in contact with the liquid coating composition and being coated with a fluorine based resin at, at least, one portion of the surface, wherein each bar is subjected in advance to a thermal pretreatment at a temperature same as or higher than that of a heat treatment of a covering process of the fluorine based resin and thereafter to grinding; each portion to be covered with the fluorine based resin is removed by grinding for the thickness of the covering with the fluorine based resin prior to the covering; a portion of each bar to be covered with the fluorine based resin is covered with the fluorine based resin for a thickness greater than the amount to be finish-grinded, then baked; and thereafter, the surface covered with the fluorine based resin is finish-grinded and/or polished to be finished with a straightness in the lateral direction of coating within a range from 0.1 to 10 μm and with a surface roughness of the portion having been subjected to covering with the fluorine based resin within a range of 0.01 μm<Ra<1 μm, and 0.1 μm<Rmax<5 μm.

23) The method of producing a die coater according to item 21 or 22, wherein the grinding includes a first grinding for removing deformation caused by the thermal pretreatment and a second grinding for forming a final finish shape.

As stated above, in the case where portions, of bars constructing a die coater, coming in contact with a liquid coating composition are covered with a fluorine based resin, the straightness of the abovementioned portions of the bars in the lateral direction of coating cannot be maintained for a long time use. As a conclusion of an intensive study for solving the problem and on the cause thereof, the inventors estimated that the internal stress of the bars generated through a heat treatment in a covering process of the fluorine based resin and a machining stress generated through producing of the die coater having the bars mounted thereon get elicited and generate deformation, and thus deteriorate the straightness of the die coater. The inventors further estimated that the deterioration of straightness causes ununiformity of the gap of a slit in the lateral direction of coating and of the distance between the die coater and an object to be coated, thus degrading the uniformity of layer thickness in the lateral direction of coating.

The inventors studied intensively on this to reduce deformation caused through covering of a bar with a fluorine based resin. As a result, it proved that a uniform layer thickness in the lateral direction of coating is attained and few coating failures are caused with improved coating quality even for a long time use, by removing, prior to covering the bar, a residual machining stress generated through production of the bar and held by the bar, thereafter covering the bar with the fluorine based resin, then finishing the bar to a desired straightness and surface roughness, and using a die coater that is produced mounting the bars thereon. Thus, the invention is attained.

There is provided a coating apparatus employing a die coater and a method of producing the die coater, wherein the die coater has a large width of 1 m or larger and is covered with a fluorine based resin at a portion coming in contact with a liquid coating composition, thereby making it possible to obtain coated products having a uniform coating layer thickness in the lateral direction of coating and few coating failures. Coating failures have decreased, layer thickness distribution has become stable, and accordingly, the product quality has become stable with an increase in the fine quality rate. Further, the straightness is not degraded even for a long elapsed time, and coating with a stable coating layer thickness in the lateral direction is allowed.

Incidentally, "straightness" is defined by JIS B0182 and "surface roughness" is defined by JIS B0601.

BRIEF DESCRIPTION OF DRAWINGS

FIG. 2*a* is a schematic diagram of an extrusion coating system that performs coating by forming beads by the use of an extrusion type die coater;

FIG. 2*b* is an enlarged schematic diagram of the extrusion type die coater shown in FIG. 2*a;*

DETAILED DESCRIPTION OF THE PREFERRED EMBODIMENT

Figure 1:
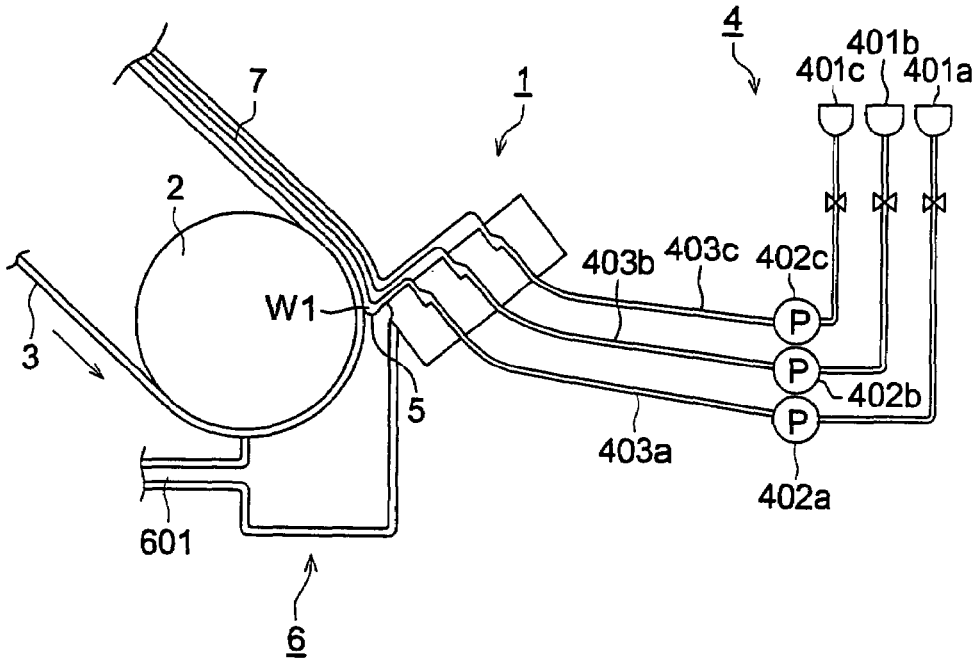
FIG. 1*a* is a schematic diagram of a slide coating system that performs coating by forming beads by the use of a slide type die coater.
FIG. 1*b* is an enlarged schematic diagram of the slide type die coater system shown in FIG. 1*a;*
Figure 1:
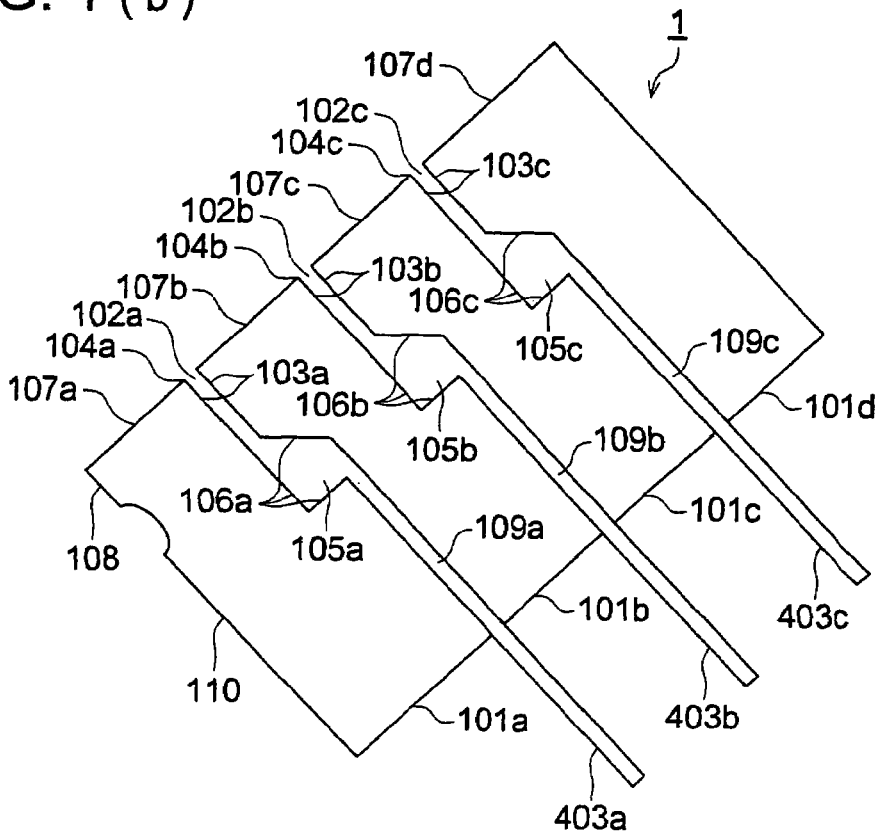

The best mode of the invention will be described referring to FIGS. 1*a* to 8, but the invention is not limited to this.

FIGS. 1*a* and 1*b* are schematic diagrams showing a slide coating system that performs coating by forming beads by the use of a slide type die coater. FIG. 1*a* is a schematic diagram of the slide coating system that performs coating on a holding section of a support, which is held by a back-roll at a surface opposite to one to be coated, in such a way that the slide type die coater forms beads. FIG. 1*b* is an enlarged schematic diagram showing the slide type die coater system shown in FIG. 1*a*.

In FIGS. 1*a* and 1*b*, numeral 1 represents the slide type die coater, 2 represents the back-roll, and 3 represents a belt-shaped support, which is continuously conveyed from upstream to downstream (in the direction shown by the arrow in the figure). The slide type die coater 1 is produced mounting respective bars 101*a* to 101*d* thereon. The quantity of bars is not fixed by the bars 101*a* to 101*d*, but can be increased or decreased depending on the quantity of layers to be coated. The back-roll is a conveying roll disposed on the surface side of the belt-shaped support 3 opposite to the coating surface side thereof, sandwiching the belt-shaped support 3 cooperating with the slide type die coater 1. Since the cylindricality of the back-roll has a significant effect on the accuracy of the gap in the lateral direction of coating as well as the slide type die coater 1, the back-roll is constructed of a metal with a large diameter of 200 mm or larger.

Numerals 102*a* to 102*c* represent slit sections that are arranged between the respective bars 101*a* to 101*d* which construct the slide type die coater and serving as an outlet of a liquid coating composition. The quantity of slit sections is variable depending on the quantity of bars such as the respective bars 101*a* to 101*d* constructing a slide type die coater, and is ordinarily 2 to 20. The slide type die coater shown in FIGS. 1*a* and 1*b* is constructed by mounting 4 bars thereon, thus having 3 slit sections, and used for simultaneous multilayer coating.

Numerals 103*a* to 103*c* represent the inner walls of the respective slit sections 102*a* to 102*c*, while numerals 104*a* to 104*c* represent edge sections at the outlets of the respective slit sections 102*a* to 102*c*. Numerals 105*a* to 105*c* represent pocket sections formed at the respective slit sections 102*a* to 102*c* so that liquid coating compositions, the liquid coating compositions having been conveyed from respective supplying pipes 403*a* to 403*c*, are extruded from the respective slit sections 102*a* to 102*c* uniformly in the lateral direction. Numerals 106*a* to 106*c* represent the inner walls of the pocket sections 105*a* to 105*c*.

Numerals 107*a* to 107*d* represent sliding surfaces. Liquid coating compositions adjusted by adjusting pots 401*a* to 401*c* of a liquid coating composition supply system 4 are fed to the respective pocket sections 105*a* to 105*c* formed between the bars 101*a* to 101*d* by liquid conveying pumps 402*a* to 402*c* through the respective supply pipes 403*a* to 403*c*, then the liquid coating compositions are ejected from the respective sections 102*a* to 102*c*, flow down along the respective sliding sections 107*a* to 107*c*, and form beads 5 through a lip section 108 to be coated on the holding section of the support 3 that is conveyed in such a way that the surface thereof on the side opposite to the surface to be coated is held by the back-roll 2.

Numeral 110 represents an outer wall that is continuous with the lip section 108. Numerals 109*a* to 109*c* represent liquid coating composition supply flow paths for supplying the liquid coating compositions, which have been conveyed from the respective pipes 403*a* to 403*c*, to the respective pocket sections 105*a* to 105*c*.

Numeral 6 represents a pressure reducing chamber for stabilizing coating, the pressure reducing chamber being arranged under the slide type die coater 1, wherein numeral 601 represents a suction pipe. Numeral 7 represents coating layers coated on the support 3, and symbol W1 represents a coating point where the slide type die coater 1 coats the liquid coating compositions on the support 3, wherein the coating point W1 is, in a typical case, preferably located at a position 0 to 20 degrees upward from the horizontal axis that goes through the back-roll.

When coating is performed for a long time, liquid coating compositions deposit on the lip section 108 and the outer wall 110 which is continuous with the lip section 108, become dry, and solidify. Further, foreign materials and silver halide grains mixed in the liquid coating compositions deposit on the respective inner walls 106*a* to 106*c* of the pocket sections 105*a* to 105*c*, on the respective inner walls 103*a* to 103*c* of the slit sections 102*a* to 102*c*, and on the respective edge sections 104*a* to 104*c* at the outlets of the slit sections 102*a* to 102*c*. When deposits are carried out by the liquid coating compositions and coated on the belt-shaped support as they are, foreign material deposit failures occur.

Also, when foreign materials and silver halide grains mixed in the liquid coating compositions deposit on the respective inner walls 103*a* to 103*c* of the slit sections 102*a* to 102*c*, the edge sections 104*a* to 104*c*, the sliding surfaces 107*a* to 107*c*, and the lip section 108, the flows of the liquid coating compositions at portions with the deposits are not normal and become streaks which cause streak failures.

Further, when a covering film created by dried liquid coating compositions adheres to the lip section 108, beads forming becomes unstable, and accordingly, coating becomes unstable. When coating films created, by dried liquid coating compositions adhere to the outer wall 110 that is continuous with the lip section 108, cleaning after terminating coating becomes painstaking. When adjusting the flow rates of liquid coating compositions or when cleaning the inside of the slit sections 102*a* to 102*c* prior to a start of coating, the liquid coating compositions flow down along the outer wall 110, and get dry and solidify. Therefore, the outer wall 110 continuous with the lip section 108 needs cleaning such as rubbing off and scraping off such created solids for each coating.

Surfaces of the slide type die coater 1 shown in FIGS. 1*a* and 1*b* that contact a liquid coating composition according to the invention include the inner walls 103*a* to 103*c* of the slit sections 102*a* to 102*c* constructed of the respective bars 101*a* to 101*d*, the edge sections 104*a* to 104*c*, the inner walls 106*a* to 106*c* of the pocket sections 105*a* to 105*c*, the liquid coating composition supply flow paths 109*a* to 109*c*, the sliding sections 107*a* to 107*c*, the lip section 108, and the outer wall 110 continuous with the lip section 108. These portions in contact with the liquid coating compositions are portions to be covered with a fluorine based resin according to the invention.

That is, in the slide type die coater 1 produced mounting the respective bars 101*a* to 101*d* thereon, portions, of the respective bars 101*a* to 101*d*, coming in contact with a liquid coating composition are the portions to be covered with a fluorine based resin according to the invention.

FIGS. 2*a* and 2*b* are schematic diagrams of an extrusion coating system that uses an extrusion type die coater to form beads and perform coating. FIG. 2*a* is a schematic diagram of the extrusion coating system that uses the extrusion type die coater to form beads and perform coating of a holding section of a support, the support having a surface, opposite to one to be coated, held by a back-roll. FIG. 2*b* is an enlarged schematic diagram of the extrusion type die coater shown in FIG. 2*a*.

Numeral 8 in FIGS. 2*a* and 2*b* represents the extrusion type die coater. The extrusion type die coater 8 is produced mounting respective bars 801*a* to 801*c* thereon. The quantity of bars is not fixed by the bars 801*a* to 801*c*, but can be increased or decreased depending on the quantity of coating layers.

Numerals 802*a* and 802*b* represent slit sections that are flow outlets of liquid coating compositions formed between the respective bars 801*a* to 801*c* that construct the extrusion type die coater 8. The quantity of slit sections is variable depending on the quantity of bars such as the respective bars 801*a* to 801*c* constructing the extrusion type die coater, and typically in a range from 1 to 5. The extrusion type die coater 8 shown in FIGS. 2*a* and 2*b* is constructed of 3 bars, having 2 slit sections for simultaneous multilayer coating.

Numerals 803*a* and 803*b* represent inner walls of the respective slit sections 802*a* and 802*b*, numerals 804*a* and 804*b* represent edge sections at the outlets of the respective slit sections 802*a* and 802*b*, and numeral 805*a* to 805*c* represent lip sections. Numerals 806*a* and 806*b* represent pocket sections formed at the respective slit sections 802*a* and 802*b* in order to push out the liquid coating compositions from the respective slit sections 802*a* and 802*b* uniformly in the lateral direction, the liquid coating compositions having been conveyed from the respective supplying pipes 403*a* and 403*b*. Numerals 807*a* and 807*b* represent inner walls of the respective pocket sections 806*a* and 806*b*.

Numerals 808*a* and 808*b* represent liquid coating composition supply flow paths for supplying the liquid coating compositions, the liquid coating compositions having been conveyed from the respective supplying pipes 403*a* and 403*b*, to the respective pocket sections 806*a* and 806*b*. Numeral 809 represents an outer wall continuous with the lip section 805*a*. The outer wall 809 is a portion that needs cleaning. Specifically, when adjusting the flow rates of liquid coating compositions or when cleaning the inside of the respective slit sections 802*a* and 802*b* prior to a start of coating, the liquid coating compositions flow down along the outer wall 809, and get dry and solidify. Therefore, the outer wall 809 needs cleaning such as rubbing off and scraping off such created solids for each coating.

Liquid coating compositions adjusted by adjusting pots 401*a* and 401*b* of a liquid coating composition supply system 4 are fed to the respective pocket sections 806*a* and 806*b* formed between the bars 801*a* to 801*c* through the respective supplying pipes 403*a* and 403*b* by respective solution conveying pumps 402*a* and 402*b*, then the liquid coating compositions are extruded from the respective slit sections 802*a* and 802*b*, pass through the lip section 805*a*, and form beads 9 to be coated on the holding section of the belt-shaped support 3 that is conveyed in such a way that the surface thereof on the side opposite to the surface to be coated is held by the back-roll 2. Symbol W2 represents a coating point where the coater 8 coats the support 3 with the liquid coating compositions, wherein the coating point W2 is, in an ordinary case, preferably located at a position 0 to 90 degrees downward from the horizontal axis that goes through the back-roll. Other symbols represent the same as those in FIGS. 1*a* and 1*b*.

When coating is performed for a long time, liquid coating compositions deposit on the lip section 805*a* and the outer wall 809 which is continuous with the lip section 805*a*, become dry and solidify. Further, foreign materials and silver halide grains mixed in the liquid coating compositions deposit on the respective inner walls 807*a* and 807*b* of the pocket sections 806*a* and 806*b*, the respective edge sections 804*a* and 804*b*, and the respective inner walls 803*a* and 803*b* of the slit sections 802*a* and 802*b*. When deposits are pushed out by the liquid coating compositions and coated on the belt-shaped support as they are, foreign material deposition failures occur. Also, when foreign materials and silver halide grains mixed in the liquid coating compositions deposit on the respective inner walls 803*a* and 803*b* of the slit sections 802*a* and 802*b*, the respective edge sections 804*a* and 804*b*, and the lip sections 805*a* to 805*c*, the flows of the liquid coating compositions at the portions with deposits become different and turn into streaks which cause streak failures. Further, when a covering film created by a dried liquid coating composition adheres to the lip section 805*a*, beads forming becomes unstable, and accordingly, coating becomes unstable. When a covering film created by a dried liquid coating composition adheres to the outer wall 809 that is continuous with the lip section 805*a*, cleaning after terminating coating becomes painstaking.

Surfaces, of the extrusion type die coater shown in FIGS. 2*a* and 2*b*, that contact liquid coating compositions according to the invention include the respective inner walls 803*a* and 803*b* of the slit sections 802*a* and 802*b*, the respective edge sections 804*a* and 804*b*, the respective inner walls 807*a* and 807*b* of the pocket sections 806*a* and 806*b*, the liquid coating composition supply flow paths 808*a* and 808*b*, the lip sections 805*a* to 805*c*, and the outer wall 809 continuous with the lip section 805*a*. These surfaces coming in contact with the liquid coating compositions are portions to be covered with a fluorine based resin according to the invention. That is, in the extrusion type die coater 8 produced mounting the respective bars 801*a* to 801*d* thereon, portions, of the respective bars 801*a* to 801*d*, coming in contact with a liquid coating composition are the portions to be covered with a fluorine based resin according to the invention.

Figure 3:
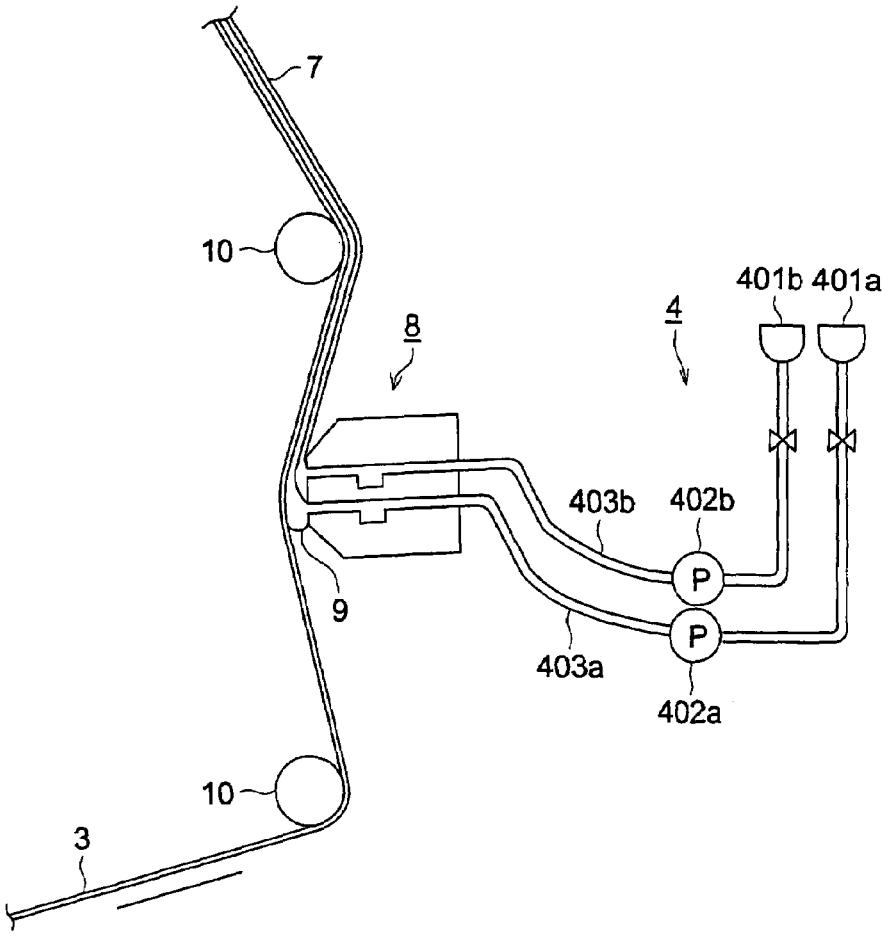
FIG. 3 is a schematic diagram of an extrusion coating system that performs coating of a support that is supported by a support roll, using an extrusion type die coater shown in FIGS. 2*a* and 2*b;*
Figure 4:
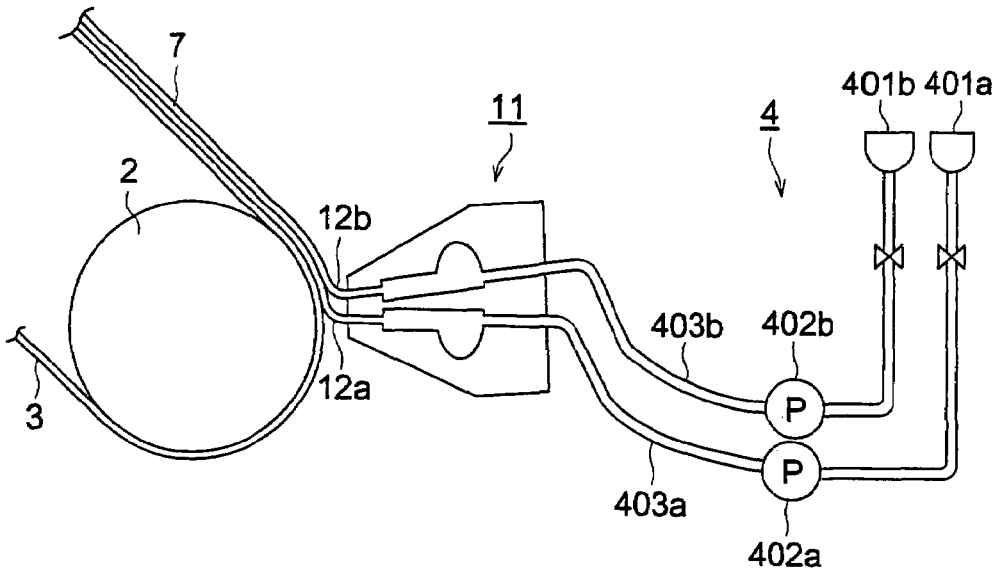
FIG. 4*a* is a schematic diagram of an extrusion coating system that uses another structure of extrusion type die coater and performs coating by colliding, across a predetermined gap from a slit section, a liquid coating composition with an object to be coated instead of forming beads.
FIG. 4*b* is an enlarged schematic diagram of the extrusion type die coater shown in FIG. 4*a;*
Figure 4:
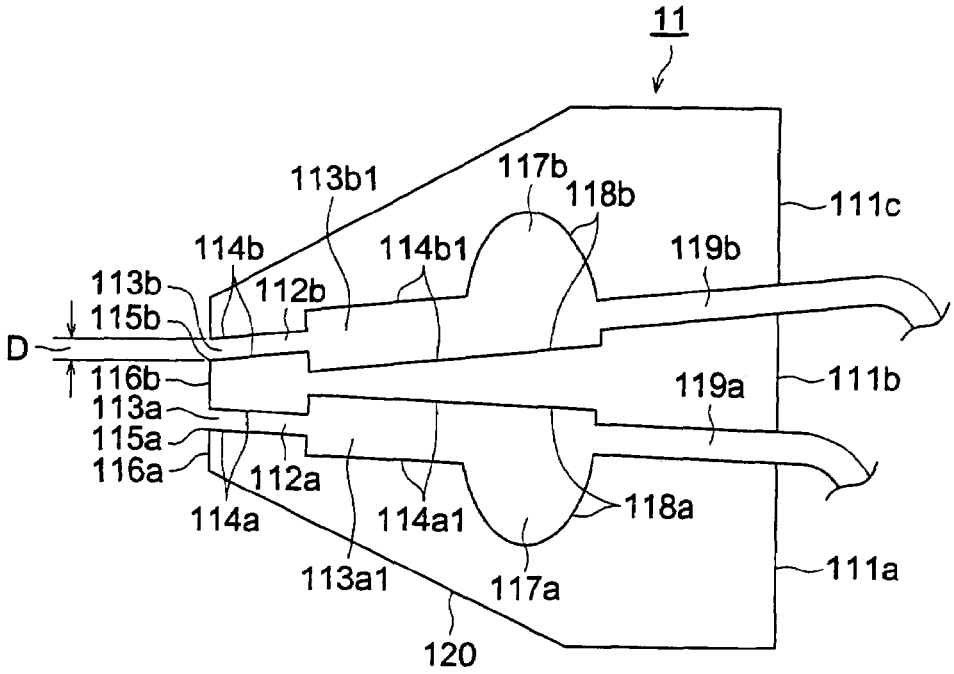

FIG. 3 is a schematic diagram showing an extrusion coating system that performs coating of a support that is supported by a support roll, using an extrusion type die coater shown in FIGS. 2*a* and 2*b*.

Numeral 10 in the figure represents the support roll. Other symbols represent the same as those in FIGS. 2*a* and 2*b*. The only difference between the coating system shown in FIG. 3 and the coating system shown in FIGS. 2*a* and 2*b* is that the coating system uses a different method of supporting of the belt-shaped support from one shown in FIG. 2*a*. Therefore, portions where liquid coating compositions deposit through a long time coating, portions where foreign materials adhere, surfaces in contact with the liquid coating compositions, and portions to be coated with a fluorine based resin are the same as those of the extrusion type die coater shown in FIGS. 2*a* and 2*b*.

FIGS. 4*a* and 4*b* are schematic diagrams of an extrusion coating system that uses another structure of extrusion type die coater and performs coating by colliding, across a predetermined gap from a slit section, a liquid coating composition with an object to be coated instead of forming beads. FIG. 4*a* is a schematic diagram of the extrusion coating system that performs coating on a holding section of a support having a surface, opposite to a surface to be coated, held by a backroll, using another structure of extrusion type die coater without forming beads. FIG. 4*b* is an enlarged schematic diagram of the extrusion type die coater shown in FIG. 4*a*.

In FIGS. 4*a* and 4*b*, numeral 11 represents the extrusion type die coater. The extrusion type die coater 11 is produced having bars 111*a* to 111*c* mounted thereon. The quantity of bars is not fixed by the bars 111*a* to 111*c*, but can be increased or decreased depending on the quantity of coating layers.

Numerals 112*a* and 112*b* represent slit sections arranged between the respective bars 111*a* to 111*c* which construct the extrusion type die coater. Numerals 12*a* and 12*b* represent coating layers formed by ejecting liquid coating compositions from the respective slit sections 112*a* and 112*b*.

The quantity of slit sections is variable depending on the quantity of bars constructing the extrusion type die coater, and is typically in a range from 1 to 5. The extrusion type die coater shown in FIGS. 4*a* and 4*b* is constructed of 3 bars, having 2 slit sections for simultaneous multilayer coating.

Numerals 113*a* and 113*b* represent the outlet sides, of liquid coating compositions, of the respective slit sections 112*a* and 112*b*, and numerals 113*a*1 and 113*b*1 represent the inlet sides of, of the liquid coating compositions, of the respective slit sections 112*a* and 112*b*. Numerals 114*a* and 114*b* represent inner walls of the respective slit sections 112*a* and 112*b* on the respective outlet sides 113*a* and 113*b* of the liquid coating compositions, and numerals 114*a*1 and 114*b*1 represent inner walls of the respective slit sections 112*a* and 112*b* on the respective inlet sides 113*a*1 and 113*b*1 of the liquid coating compositions. Numerals 115*a* and 115*b* represent edge sections of the respective slit sections 112*a* and 112*b*, and numerals 116*a* and 116*b* represent lip sections. Numerals 117*a* and 117*b* represent pocket sections formed at the respective slit sections 112*a* and 112*b* to extrude the liquid coating compositions, the liquid coating compositions having been conveyed from the respective supply pipes 403*a* and 403*b*, out from the respective slit sections 112*a* and 112*b* uniformly in the lateral direction. Numerals 118*a* and 118*b* represent inner walls of the respective pocket sections 117*a* and 117*b*.

Numerals 119*a* and 119*b* represent liquid coating composition supply flow paths for supplying the liquid coating compositions, the liquid coating compositions having been conveyed from the respective supplying pipes 403*a* and

403*b*, to the respective pocket sections 117*a* and 117*b*. Numeral 120 represents an outer wall continuous with the lip section 116*a*. The outer wall 120 is a portion that needs cleaning. Specifically, when adjusting the flow rates of liquid coating compositions or when cleaning the inside of the respective slit sections 112*a* and 112*b* prior to a start of coating, the liquid coating compositions flow down along the outer wall 120, and get dry and solidify. Therefore, the outer wall 120 needs cleaning such as rubbing off and scraping off such created solids for each coating.

Surfaces, of the extrusion type die coater shown in FIGS. 4*a* and 4*b*, that contact with liquid coating compositions include the respective inner walls 114*a* and 114*b* of the slit sections 112*a* and 112*b* on the outlet side 113*a* and 113*b* of the liquid coating compositions, the respective inner walls 114*a*1 and 114*b*1 of the slit sections 112*a* and 112*b* on the inlet side 113*a*1 and 113*b*1 of the liquid coating compositions, the edge sections 115*a* and 115*b*, the respective lip sections 116*a* and 116*b*, the respective inner walls 118*a* and 118*b* of the pocket sections 117*a* and 117*b*, the respective liquid coating composition supplying flow paths 119*a* and 119*b*, and the outer wall 120 continuous with the lip section 116*a*. These surfaces coming in contact with the liquid coating compositions are portions to be coated with a fluorine based resin. That is, in the extrusion type die coater 11 produced having the respective bars 101*a* to 101*c* mounted thereon, portions of the respective bars 111*a* to 111*c* coming in contact with a liquid coating composition are the portions to be covered with a fluorine based resin according to the invention.

The liquid coating compositions adjusted by adjusting pots 401*a* and 401*b* of a liquid coating composition supply system 4 are supplied to the respective pocket sections 117*a* and 117*b* arranged between the respective bars 111*a* to 111*c* through the respective supply pipes 403*a* and 403*b* by liquid conveying pumps 402*a* and 402*b*, then the liquid coating compositions are ejected from the respective slit sections 112*a* and 112*b* in a layer form so that the liquid coating compositions are collided with the holding section of the belt-shaped support 3 that is conveyed in such a way that the surface thereof on the side opposite to the surface to be coated is held by the back-roll 2, and thus the liquid coating compositions are coated on the holding section of the belt-shaped support 3.

Symbol D represents an outlet gap of a slit section. The outlet gap D can be properly adjusted depending on the physical properties of a liquid coating composition to be used and the thickness of a coating layer. The gap of the slit section is wider on the inlet side of the liquid coating composition and narrower on the outlet side, wherein the outlet gap D of the slit section is in a range of $D \leqq 5\times10^{-5}$ [m]. More preferably, D is in a range of $1\times10^{-5}$ [m] $\leqq D \leqq 4\times10^{-5}$ [m]. The outlet gap D is set in such a range so that the liquid coating composition is ejected in an extremely thin layer form that allows thin layer coating compared with known extrusion type die coaters.

In the case of the extrusion type die coater shown in FIGS. 4*a* and 4*b*, portions where foreign materials and silver halide grains deposit in the course of coating for a long time are the same as those of the extrusion type die coater shown in FIGS. 2*a* and 2*b*.

Figure 5:
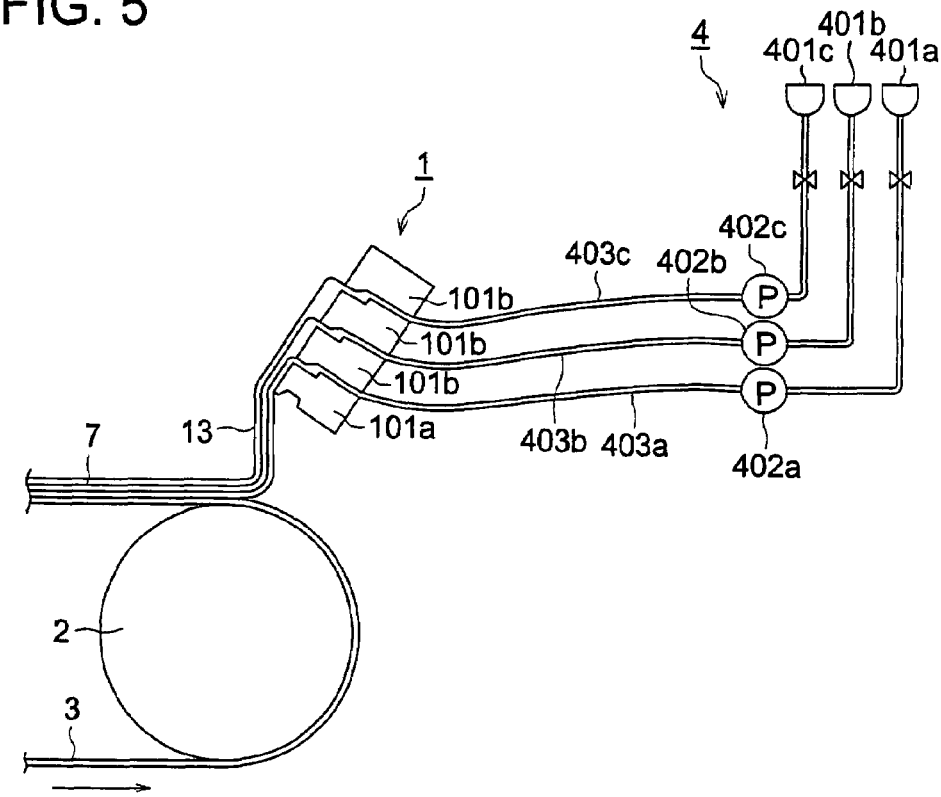
FIG. 5 is a schematic diagram of a curtain coating system using the slide type die coater shown in FIGS. 1*a* and 1*b;*

FIG. 5 is a schematic diagram of a curtain coating system using the slide type die coater shown in FIGS. 1*a* and 1*b*.

In FIG. 5, numeral 13 represents layers formed in such a way that liquid coating compositions extruded out from the outlets of respective slit sections flow down along a sliding surface in a state the liquid coating compositions are laminated and fall with gravity. The layers 13 are coated on a belt-shaped support. Other symbols represent the same as those in FIGS. 1*a* and 1*b*.

In the case of the slide type die coater shown in FIG. 5, surfaces in contact with liquid coating compositions, portions subjected to covering with a fluorine based resin, and portions where foreign materials and silver halide grains deposit through coating for a long time, are the same as those of the slide type die coater shown in FIGS. 1*a* and 1*b*. In the invention, the slide type die coater and the extrusion type die coaters shown in FIGS. 1*a* to 5 are also referred to as a die coater to be a generic term.

In the various types of die coaters shown in FIGS. 1*a* to 5, a pocket section is usually designed in a large cross section for a low flow velocity so that a liquid coating composition is distributed in a uniform pressure in the lateral direction of coating. In general, foreign materials and silver halide grains in a liquid coating composition easily deposits on a surface of a die coater. Once they have deposited, the depositions turn into a core and grow, and then get torn by some trigger to be mixed in the liquid coating composition, causing a coating failure. Therefore, covering with a fluorine based resin to prevent deposition is effective in preventing occurrence of coating failures.

Since a slit section has a narrow gap, if foreign materials and silver halide grains in the liquid coating composition deposit on a surface even a little, the flow path is blocked to cause a streak-shape failure. Therefore, performing coating with fluorine based resin to avoid deposition is effective in preventing occurrence of coating failure.

When the straightness of a slit section is low, it is difficult to eject a liquid coating composition in the lateral direction of a die coater with a uniform pressure, thus the ejection amount of the liquid coating composition is unstable in the lateral direction, and the coating layer thickness in the lateral direction is not constant. Therefore, making the straightness small is effective in achieving a constant coating layer thickness in the lateral direction.

To prevent deposition of foreign materials and silver halide grains in a liquid coating composition on a lip section, it is quite effective to cover the lip section with a fluorine based resin as well as in the case of a slit section. Particularly at a lip section, which is on the lowest downstream side, when a liquid coating composition having come round beads and deposited gets dry and solidifies, beads cannot be formed stably, and accordingly, stable coating is not allowed. Therefore, it is extremely effective to cover with a fluorine based resin in preventing deposition to avoid coating failures.

If the straightness of a lip section is low, forming of beads is unstable in the lateral direction, and it is impossible to perform stable coating, by which the coating layer thickness in the lateral direction is not constant. Therefore, it is effective to make the straightness small in achieving a constant coating layer thickness in the lateral direction.

Since a liquid coating composition on a sliding surface flows down with gravity, the flow velocity is small, by which foreign materials and silver halide grains in the liquid coating composition tend to deposit as well as in a pocket section. Therefore, it is extremely effective to cover a fluorine based resin in preventing deposition to avoid coating failures.

When the straightness of a sliding surface is low, a liquid coating composition flows down on the sliding surface unstably, and it is impossible to perform stable coating, by which the coating layer thickness in the lateral direction is not constant. Therefore, it is effective to make the straightness small in achieving a constant coating layer thickness in the lateral direction.

An edge is also a part where foreign materials and silver halide grains in a liquid coating composition tend to deposit, and deposition, when occurred, makes a flow of the liquid coating composition unstable to cause a streak failure. Therefore, it is effective to cover with a fluorine based resin in preventing deposition to avoid coating failures.

When the straightness of an edge is low, the ejection amount of a liquid coating composition is unstable in the lateral direction of a slit, and it is impossible to perform stable coating, by which the coating layer thickness in the lateral direction is not constant. Therefore, it is effective to make the straightness small in achieving a constant coating layer thickness in the lateral direction.

When adjusting the flow rates of liquid coating compositions or when cleaning the inside of respective slit sections prior to a start of coating, the liquid coating compositions flow down along an outer wall that is continuous with a lip section, deposit, and get dry and solidify, which requires cleaning such as rubbing off and scraping off for each coating. Thus, the outer wall continuous with the lip section is a part which takes time to be cleaned. It is effective to cover a fluorine based resin on the outer wall continuous with the lip section in greatly reducing deposition of liquid coating compositions, which shorten the time for cleaning.

In the case of coating by a die coater that is produced having bars, the bars having been subjected to covering with a fluorine based resin at portions thereof coming in contact with a liquid coating composition, mounted thereon, the portions of the die coater in contact with a liquid coating composition have less dirt, but, through a long elapsed time, coating with a uniform coating layer thickness in the lateral direction of coating may not be achieved, which particularly tends to occur on a die coater having a large coating width not smaller than 1 m.

Although, in the case of covering portions of a bar, the portions coming in contact with a liquid coating composition, with a fluorine based resin, a heat treatment for cleaning of processing surfaces and a heat treatment called a baking treatment for sticking a fluorine based resin to a base material are performed at a temperature of 400 to 500° C., as a result of an intensive study by the inventors, it proved that deformation caused by an inner stress generated and accumulated through processing of the bar gets elicited and deteriorates the straightness of the bar, and a die coater produced having bars in this state mounted thereon has a low straightness thereof.

The present invention relates to a coating apparatus employing a die coater having at least two bars mounted thereon, and relates to a method of producing the die coater, wherein each bar is covered with a fluorine based resin at least at portions thereof coming in contact with a liquid coating composition including a pocket section for extending the liquid coating composition in the coating lateral direction of coating, a liquid coating composition supply inlet for supplying the liquid coating composition to the pocket section, a slit section for ejecting the liquid coating composition from the pocket section onto an object to be coated, and a wall continuous with a lip section.

In the invention, a covering process heat treatment is referred to, including a heat treatment for cleaning surfaces, to be covered, in the covering process with a fluorine based resin and a baking treatment.

As a first means for stable coating with a minimum possible deformation of a bar due to a heat treatment of a covering process with a fluorine based resin, it is effective to make the straightness of the bars within a range from 0.1 to 10 μm by grinding-removing the deformation caused by the covering process with the fluorine based resin. Further, covering each bar with the fluorine based resin in a thickness greater than that of grinding enables correction by grinding of the deformation of the bar caused by the baking treatment, and further enables this correction of the deformation caused by the baking treatment in such a manner that the deformation is removed by grinding only the fluorine based resin without grinding the bar, by which the residual grinding stress in the bar is reduced. Therefore, utilizing a die coater produced having such processed bars mounted thereon prevents the residual grinding stress in the bars from gradually getting elicited and prevents the straightness of the die coater from degrading even after a long elapsed time, and makes stability of the slit gap in the lateral direction of coating and the distance between the die coater and an object to be coated, thereby enabling coating excellent in the uniformity of the layer thickness in the lateral direction of coating. Further, stable coating is achieved also in the aspect that the portions coming in contact with a liquid coating composition are covered with a fluorine based resin to be protected from dirt even for a long time coating.

As a second means, a residual machining stress which is caused when a bar is produced and is latent in the bar is removed prior to the covering process. The inventors found that, as a means for removing the residual machining stress, it is effective to perform a thermal pretreatment at the temperature same as or higher than that of a covering process heat treatment, thereafter remove deformation by grinding, and then cover the bar with the fluorine based resin. It is difficult to determine the upper limit of the temperature of the thermal pretreatment because it varies with the material to be employed for the bar, but at least, it should be lower than the melting point of the material.

Deformation amount generated on the bar can be reduced by performing a thermal pretreatment, removing the generated deformation by grinding, thereafter cleaning the portions to be covered a with fluorine based resin by a heat treatment, covering the portions with the fluorine based resin, and performing a baking treatment. The smaller deformation amount requires a smaller amount of finish grinding after the baking treatment, and thus the residual grinding stress in the bar is reduced. Therefore, utilizing a die coater produced having such processed bars mounted thereon prevents the residual grinding stress in the bars from gradually getting elicited and prevents the straightness of the die coater from degrading even after a long elapsed time, and makes stability of the slit gap in the lateral direction of coating and the distance between the die coater and an object to be coated, thereby enabling coating excellent in the uniformity of the layer thickness in the lateral direction of coating. Further, stable coating is achieved also in the aspect that the portions coming in contact with a liquid coating composition are covered with a fluorine based resin to be protected from dirt even for a long time coating.

By performing the thermal pretreatment on the bar in advance at the same temperature or higher than that of the covering process heat treatment, then removing the caused deformation, and thereafter coating with the bar with fluorine based resin, deformation of the bar caused by the baking treatment can be reduced, even if the die coater has a large width not smaller than 1 m for which reduction of deformation has been difficult before. Particularly, a bar for a die coater with a large width ranging from 1 to 4 m is preferably suitable.

In the case of covering only a part (for example, only in the vicinity of a pocket section of a slit face) of a single surface (for example, a slit face) of a bar with a fluorine based resin, the inventors found that, as a means for having both a portion covered with a fluorine based resin and a portion not covered with the fluorine based resin on the same surface, it is effective to remove the material of the bar, by grinding prior to covering, at the portion to be covered with the fluorine based resin for the thickness of covering, and then cover the portion with the fluorine based resin.

In such a manner, grinding of the surface can be proceeded to the extent that no step remains between the portion covered with the fluorine based resin and the portion not covered, by which a stable flatness is obtained, permitting a stable coating. Since fluorine based resins are usually softer than metals, in the case where the roundness at an angular part such as an edge or lip of a die coater is required to be 5 mm or smaller, covering the angular part with a fluorine based resin is not suitable due to durability of the angular part, but it is allowed to omit covering of the vicinity of the angular part with the fluorine based resin in this case.

Further, after performing the first means and the second means, a surface having been covered with the fluorine based resin is subjected to finish grinding and/or polishing so that the surface is finished with the straightness in the lateral direction of coating within a range from 0.1 to 10 μm and the surface roughness of the portion covered with the fluorine based resin within a range of 0.01 μm<Ra<1 μm and 0.1 μm<Rmax<5 μm, thereby enabling stable coating.

There is no particular limitation on a fluorine based resin to be used to practice the invention, and For example polytetrafluoroethylene (PTFE), tetrafluoroethylene—soft-headed fluoroalkyl vinyl ether copolymer (PFA), tetrafluoroethylene—hexafluoropropylene copolymer (a FEP), polychlorotrifluoroethylene copolymer (PCTFE), polyvinyl fluoride (PVF) and a polyvinylidene fluoride (PVDF) may be usable.

A method of producing a die coater of the invention will be described referring to FIGS. 6 to 8.

Figure 6:
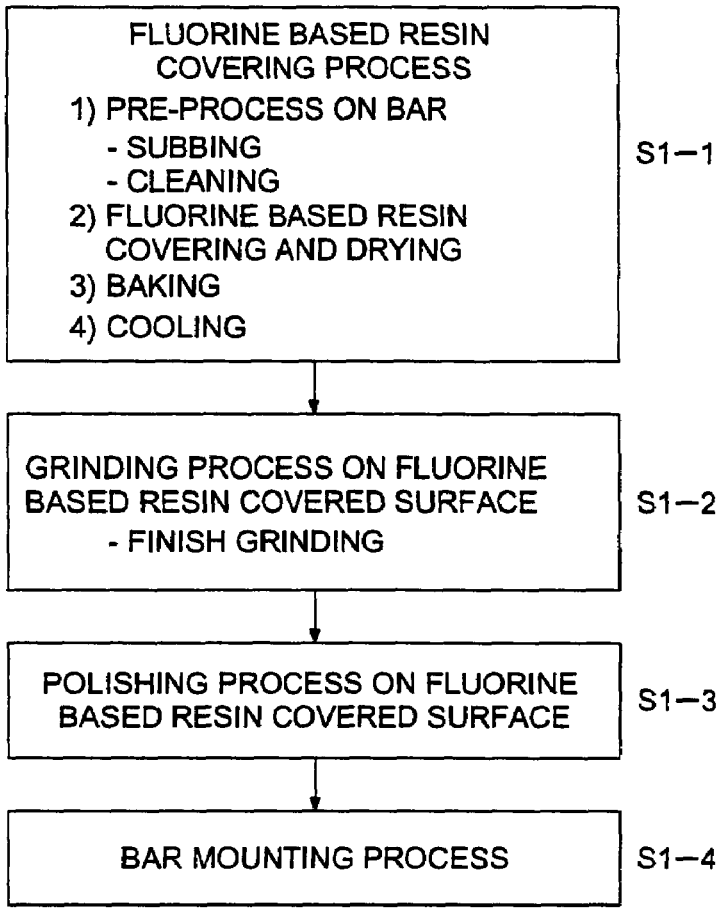
FIG. 6 is a schematic flowchart showing a method of producing a die coater having bars mounted thereon, the bars being covered with a fluorine based resin.

FIG. 6 is a schematic flowchart showing a method of producing a die coater having bars mounted thereon, the bars being covered with a fluorine based resin.

Producing a die coater covered with a fluorine based resin at portions coming in contact with a liquid coating composition can be divided into a fluorine based resin covering process S1-1, a grinding process S1-2 of grinding surfaces covered with the fluorine based resin, a polishing process S1-3 of polishing the surfaces covered with the fluorine based resin, and a mounting process S1-4 of mounting bars. Each process will be described below.

The fluorine based resin covering process S1-1 comprises 1) a pre-treatment process of a bar, 2) a covering (painting, immersion, etc.) and drying process, 3) a baking process, and 4) a cooling process. A desired layer thickness can be attained through these four processes, and through a repeat of these processes if necessary.

The pre-treatment process of a bar includes 1) a foundation treatment process that makes the fluorine based resin covering surfaces of the bar rough by sandblast or the like prior to fluorine based resin covering in order to give excellent adherability and prevent peeling after the fluorine based resin covering, and 2) a sweeping treatment or a heat treatment for cleaning of the surfaces to be covered with the fluorine based resin. It is necessary that the temperature of the heat treatment for cleaning is the same as or lower than that for the baking treatment. If the temperature is higher than that for the baking treatment, it is possible that a greater deformation is caused than that caused by the baking treatment, by which the grinding amount for removing deformation increases and a grinding stress remains in the bar. In the invention, a covering process heat treatment is referred to, including a heat treatment for cleaning and a baking treatment performed after the fluorine based resin covering, wherein the temperature of the covering process heat treatment is usually within a range from 400 to 500° C., and possibly higher than 500° C. The temperature of the heat treatment for cleaning of resin covering surfaces and that for the baking treatment may be the same. The covering/drying process with a fluorine based resin is a process that performs covering a bar having been subjected to pre-process with the fluorine based resin by painting, immersion, etc. and performs drying. The covering thickness of the fluorine based resin is required to be greater than the amount of deformation of the bar in order to grinding-remove, after covering, bend and torsion of the bar due to the deformation thereof caused by the baking treatment after the fluorine based resin covering. Accordingly, the covering thickness of the fluorine based resin ranges from 0.1 to 1.0 mm. By grinding this thick fluorine based resin in an amount smaller the thickness thereof, the portions covered with the fluorine based resin can be finally formed in a required straightness, surface roughness, and shape. If the covering layer thickness is smaller than 0.1 mm, when grinding the surfaces covered with the fluorine based resin, the fluorine based resin cover may be lost before removing bend and torsion due to the deformation of the bar. If the covering layer thickness is greater than 1 mm, the thickness is greater than required, which may raise the cost depending on the type of the fluorine based resin.

The baking process is a process for sticking the fluorine based resin to the die coater. The temperature of the baking process in the fluorine based resin covering process is usually in a range from 400 to 500° C., and possibly higher than 500° C.

The cooling process cools the bar after the baking.

The finish grinding process S1-2, of the surfaces covered with the fluorine based resin, grinds and corrects the deformation caused by the baking treatment performed after the fluorine based resin covering, and finishes the straightness of the surfaces of the bar in the lateral direction of coating to a required straightness. The straightness of a surface of a die coater according to the invention ranges from 0.1 to 10 μm (per meter) in the lateral direction of coating. By making the straightness of surfaces in the lateral direction of coating within a range from 0.1 to 10 μm, a uniform coating layer is achieved. If the straightness is smaller than 0.1 μm, machining is difficult due to the limit on the grinding accuracy. If the straightness is greater than 10 μm, it is not preferable because the coating layer thickness becomes unstable.

In the invention, since the thickness of a fluorine based resin covering is made greater than the grinding amount for correcting the deformation caused by the baking treatment, in the case where finish grinding surfaces are entirely covered with the fluorine based resin, it is allowed to reduce machining stress that remains in the bar because a metal portion of the bar is not grinded.

The polishing process S1-3 of polishing the surfaces covered with the fluorine based resin means polishing that makes the surface roughness of the surfaces covered with the fluorine based resin within a range of 0.01 μm<Ra<1 μm, and 0.1 μm<Rmax<5 μm. By attaining such a surface roughness, foreign materials and silver halide grains in a liquid coating composition are prevented from depositing and the flow of the liquid coating composition is made smooth even for a long time coating, thus preventing coating failure and stably obtaining uniform coating layers. A polishing machine may be used for polishing, and manual polishing using polishing powder is also allowed.

In the case where the surface roughness Ra is smaller than 0.01 μm, machining is difficult, and the straightness at the portions covered with the fluorine based resin may be deteriorated, which is not preferable. In the case where the surface roughness Ra is greater than 1 μm, surfaces are rough, by which the abovementioned foreign materials tend to deposit easily and the effect of the fluorine based resin covering is reduced, which is not preferable.

In the case where the surface roughness Rmax is smaller than 0.1 μm, machining is difficult, and the straightness at the portions covered with the fluorine based resin may be deteriorated, which is not preferable. In the case where the surface roughness Rmax is greater than 5 μm, surfaces are rough, by which the abovementioned foreign materials tend to deposit easily and the effect of the fluorine based resin covering is reduced, which is not preferable.

The bar mounting process S1-4 mounts at least 2 bars having been subjected to the polishing process S1-3 and produces a die coater.

Through the processes S1-1 to S1-4, a die coater, according to the invention, that is covered with a fluorine based resin at portions coming in contact with a liquid coating composition is achieved.

Figure 7:
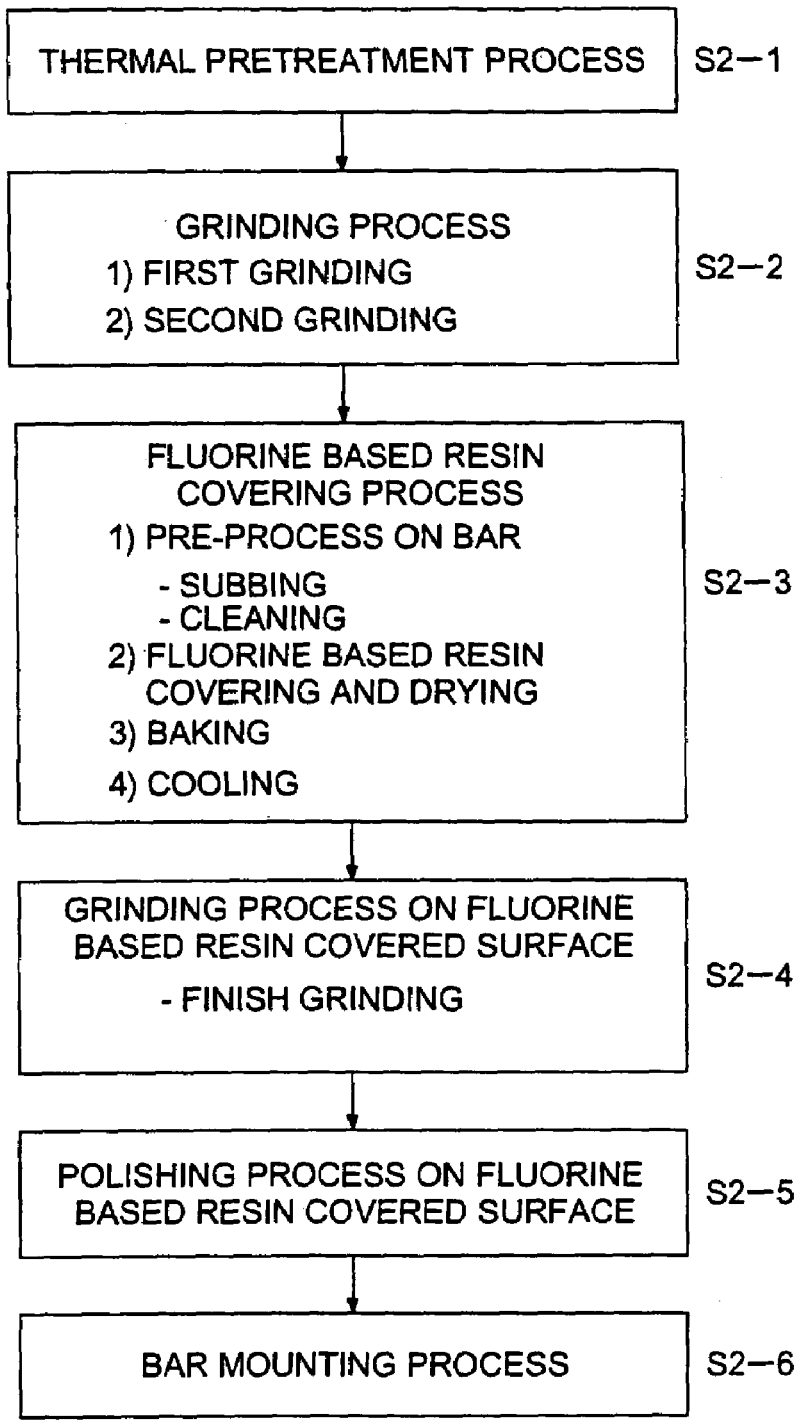
FIG. 7 is a schematic flowchart showing a method of producing a die coater having bars mounted thereon, the bars having been subjected to a thermal pretreatment, thereafter to grinding, and then to fluorine based resin covering.

FIG. 7 is a schematic flowchart showing a method of producing a die coater having bars mounted thereon, the bars having been subjected to a thermal pretreatment, thereafter to grinding, and then to fluorine based resin covering.

Producing of a die coater covered with a fluorine based resin at portions coming in contact with a liquid coating composition can be divided into the processes, namely, a thermal pretreatment process S2-1 on a bar, a grinding process S2-2, a fluorine based resin covering process S2-3, a grinding process S2-4 on the surfaces covered with the fluorine based resin, a polishing process S2-5 on the surfaces covered with the fluorine based resin, and a bar mounting process S2-6. Each process will be described below.

The thermal pretreatment process S2-1 on a bar is executed prior to the heat treatment of a fluorine based resin covering process, and performs heat treatment at a temperature same as or higher than that of the heat treatment of the fluorine based resin covering process to elicit deformation generated by an inner stress or a machining stress which are caused through producing the bar, thereby reducing the deformation caused by the heat treatment of the fluorine based resin covering process. The heat treatment of the fluorine based resin covering process means a heat treatment for cleaning of surfaces to be covered in the fluorine based resin covering process and a baking process. The temperature of the covering process heat treatment is usually within a range from 400 to 500° C., and sometimes higher than 500° C. It is difficult to determine the upper limit of the temperature of the thermal pretreatment because it varies with a material to be employed for the bar, but at least, it should be lower than the melting point of the material. By performing the thermal pretreatment, the deformation of the bar caused by the covering process heat treatment can be reduced.

The grinding process S2-2 includes 1) a first grinding process for correction of deformation accompanying the elicitation of the inner stress caused in the thermal pretreatment process S2-1 on the bar and the machining stress generated through producing the bar and 2) a second grinding process of forming a final shape. By performing the first grinding and the second grinding, only a slight amount of grinding in the finish grinding process is required after the fluorine based resin covering, thus avoiding removal of all the amount of the fluorine based resin cover by grinding. Thus, it is possible to make the fluorine based resin cover 0.1 mm thick or thinner. Also, it is possible to reduce the machining stress caused by this grinding, allowing it to reduce generation of deformation of the bar after a long elapsed time. The second grinding process of forming the final finished shape means a grinding process for forming the shape of a die coater in a design drawing.

In the fluorine based resin covering process S2-3, the thickness of a fluorine based resin film formed through the fluorine based resin covering can be as small as 0.1 mm or smaller, because almost no deformation is caused by baking after the fluorine based resin covering, which is achieved by the thermal pretreatment, and only finish grinding in a small amount of grinding is required after the fluorine based resin covering. However, in the case where the fluorine based resin cover is thinner than 0.03 mm, the fluorine based resin cover may be lost by grinding the surface of the fluorine based resin cover, which requires careful attention to be prevented. On the other hand, although the covering film thickness may be greater than 0.1 mm, then the covering film tends to be thicker than required, causing a higher cost depending on the type of the fluorine based resin. The preprocess, the baking process, and the cooling process in the fluorine based resin covering process S2-3 are the same as those of the process shown in FIG. 6.

In the following, the grinding process S2-4 on the surfaces covered with the fluorine based resin, the polishing process S2-5 on the surfaces covered with the fluorine based resin, and the bar mounting process S2-6 are the same as the processes S2-2 to S2-4 shown in FIG. 6.

It is possible to produce a die coater, according to the invention, that is covered with a fluorine based resin at portions coming in contact with a liquid coating composition through the processes S2-1 to S2-6.

Figure 8:
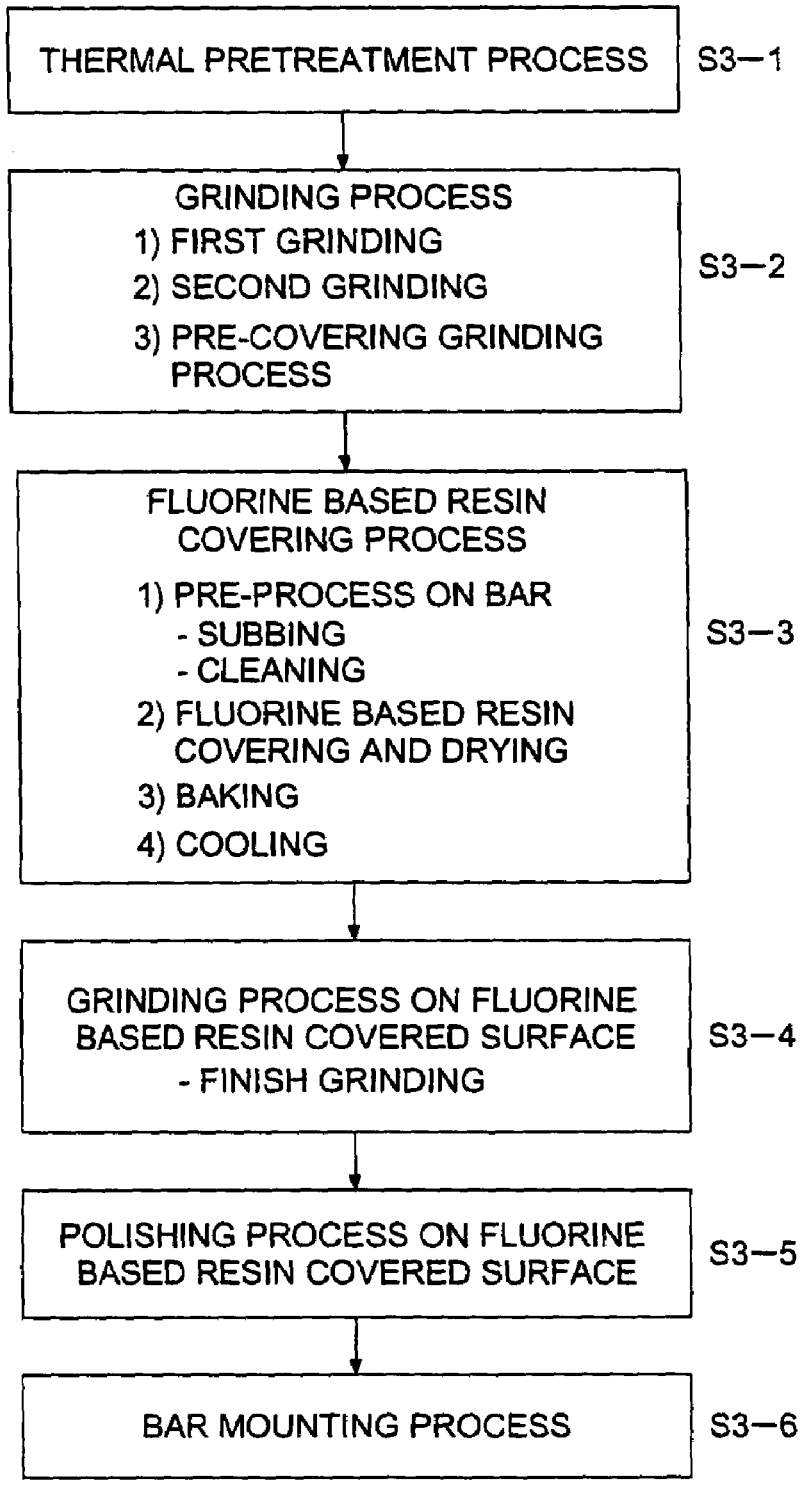
FIG. 8 is a schematic flowchart showing another method of producing a die coater having bars mounted thereon, the bars having been subjected to a thermal pretreatment, thereafter to grinding, and then to fluorine based resin covering.

FIG. 8 is a schematic flowchart showing another method of producing a die coater having bars mounted thereon, the bars having been subjected to a thermal pretreatment, thereafter to grinding, and then to fluorine based resin covering.

In the method of producing a die coater shown in FIG. 8, a pre-resin-covering grinding process for removing the material for the thickness of a fluorine based resin is added to the grinding process S2-2 of the method shown in FIG. 7. By grinding-removing the material, in advance prior to covering, at portions to be covered with a fluorine based resin, for the thickness of the fluorine based resin, and thereafter covering the grinded portions with the fluorine based resin to be thick, even if the covered surface is grinded, it is allowed to obtain a uniform surface having an excellent straightness without causing a step between a portion which is not covered and a portion which is covered, and further, retention of a liquid coating composition and deposition of foreign materials are prevented, which is an effective means. The rest of S3-1 to S3-6 are the same as those in FIG. 7.

It is possible to produce a die coater, according to the invention, that is covered with a fluorine based resin at portions coming in contact with a liquid coating composition through the processes S3-1 to S3-6.

By the method of producing a die coater, shown in FIGS. 6 to 8, according to the invention, various die coaters, shown in FIGS. 5 to 8, that perform wide web coating in a coating width ranging from 1 to 4 m have advantages including 1) reducing deformation that accompanies fluorine based resin covering, 2) enabling fluorine based resin covering of the portions, of the die coater, coming into contact with a liquid coating composition with accuracy, 3) achieving a stable straightness of the die coater due to being free from variation of the straightness of bars which construct a die coater even for a long elapsed time, and maintaining evenness of a slit gap in the lateral direction of coating and the distance between the die coater and an object to be coated, and 4) preventing foreign materials and silver halide grains in the liquid coating composition from depositing on the portions in contact with the liquid coating composition even for a long time coating. Thus, a coating apparatus is achieved that employs a die coater which attains an excellent coating quality with a uniform thickness in the lateral direction of coating and few coating failures while keeping the cleanability of known die coaters. The method of producing a die coater of the invention is effective for die coaters for performing wide web coating with a width of 1 m or larger, and particularly effective for die coaters for performing wide web coating with a width ranging from 1 to 4 m.

A support to be used in practicing the invention is not limited in type as long as a support has a belt shape and is conveyable, and for example, a paper sheet, a plastic film, and a metal sheet can be used. As paper sheets, resin coat papers and composite papers can be applied, for example. As plastic films, polyolefin film (for example polyethylene film, polypropylene film), polyester film (for example, polyethylene terephthalate film, 2,6-polyethylene naphthalate film), polyamide film (for example polyeter ketone film), cellulose acetate (for example cellulose triacetate) may be usable. As metal sheets, aluminum plates are representative. Further, there is no particular limit on the thickness of a support to be employed.

A liquid coating composition to be employed in practicing the invention is not limited particularly, and it is allowed to use, for example, liquid coating compositions for photographic photosensitive materials, thermal development recording materials, abrasion recording materials, magnetic recording media, steel plate surface treatment, and electrophotographic photoreceptors (including liquid coating compositions for subbing, overcoating, and a backside layer). Among these, particularly preferable are liquid coating compositions for photoreceptive layers which are liquid coating compositions for thermal development photoreceptive materials and contain a silver component, and liquid coating compositions for non-photoreceptive protective layers.

EXAMPLES

The present invention will now be described with reference to examples. However, the present invention is not limited thereto.

Example 1

A light-sensitive layer liquid coating composition containing organic silver, and a surface protective layer liquid coating composition were prepared based on the method described below.

<Preparation of Light-Sensitive Layer Liquid Coating Composition>

<<Preparation of Silver Halide Emulsion A>>

Dissolved in 900 ml of water were 7.5 g of gelatin and 10 mg of potassium bromide. The resulting solution was maintained at 35° C. and the pH was adjusted to 3.0. Thereafter, 370 ml of an aqueous solution containing 74 g of silver nitrate and 370 ml of an aqueous solution containing potassium bromide and potassium iodide at a mol ratio of (98/2), as well as an $[Ir(NO)Cl_6]$ salt in an amount of $1\times10^{-6}$ mol per mol with respect to mol of silver, and rhodium chloride in an amount of $1\times10^{-6}$ mol with respect to mol of silver were added employing a controlled double jet method while maintaining pAg at 7.7. Thereafter, 4-hydroxy-6-methyl-1,3,3a,7-tetraazaindene was added and the pH of the resulting mixture was adjusted to 5 by the addition of NaOH, whereby cubic silver iodobromide grains at an average grain size of 0.06 μm, a degree of monodispersion of 10 percent, a variation coefficient of the projected diameter area of 8 percent, and a [100] plane ratio of 87 percent were prepared. The resulting emulsion was coagulated employing gelatin coagulants, and then desalted. Thereafter, 0.1 g of phenoxyethanol was added and the pH and pAg of the resulting mixture were adjusted to 5.9 and 7.5, respectively, whereby a silver halide emulsion was prepared. In addition, the resulting silver halide emulsion underwent chemical sensitization employing chloroauric acid and inorganic sulfur, whereby Silver Halide Emulsion A was prepared.

The above-mentioned degree of monodispersion and variation coefficient of projected diameter area were calculated employing the formulas below:

Degree of monodispersion (in percent)=(standard deviation of grain diameter)/(average value of grain diameter)×100 Variation coefficient of projected diameter area (in percent)=(standard deviation of projected diameter area)/(average value of projected diameter area)×100

<<Preparation of Sodium Behenate Solution>>

Under vigorous stirring, 32.4 g of behenic acid, 9.9 g of arachidic acid, and 5.6 g of stearic acid were dissolved at 90° C. in 945 ml of pure water. Subsequently, while still vigorously stirring, 98 ml of an aqueous 1.5 mol/L sodium hydroxide solution was added. After adding 0.93 ml of concentrated nitric acid, the resulting mixture was cooled to 55° C. and stirred for 30 minutes, whereby a sodium behenate solution was prepared.

(Preparation of Pre-Formed Emulsion)

Added to the above-mentioned sodium behenate solution was 15.1 g of the aforesaid Silver Halide Emulsion A, and the pH of the resulting mixture was adjusted to 8.1 by the addition of sodium hydroxide. Thereafter, 147 ml of a 1 mol/L silver nitrate solution was added over a period of 7 minutes. The resulting mixture was stirred for an additional 20 minutes, and water-soluble salts were removed utilizing ultrafiltration. The resulting silver behenate was comprised of particles at an average particle size of 0.8 μm and a degree of monodispersion of 8 percent. After forming flakes of the dispersion, water was removed. Thereafter, water washing was repeated 6 times, and water was then removed, followed by drying. Subsequently, 544 g of a methyl ethyl ketone solution (17 percent by weight) of polyvinyl butyral (at an average molecular weight of 3,000) and 107 g of toluene were gradually added and stirred. The resulting mixture was dispersed at 27.6 MPa, employing a media homogenizer, whereby a pre-formed emulsion was prepared.

<Preparation of Light-Sensitive Layer Liquid Coating Composition>

| | |
|---|---|
| Pre-formed emulsion | 240 g |
| Sensitizing Dye 1 (0.1 percent methanol solution) | 1.7 ml |
| Pyridiniumpromideperbromide (6 percent methanol solution) | 3 ml |
| Calcium bromide (0.1 percent methanol solution) | 1.7 ml |
| Antifogging Agent 1 (10 percent methanol solution) | 1.2 ml |
| 2-(4-chlorobenzoylbenzoic acid (12 percent methanol solution) | 9.2 ml |
| 2-mercaptobenzimodazole (1 percent methanol solution) | 11 ml |
| Tribromomethylsulfoquinoline (5 percent methanol solution) | 17 ml |
| Developing Agent 1 (20 percent methanol solution) | 29.5 ml |

-continued

| | |
|---|---|
| Tetrachlorophthalic acid | 150 mg/m$^2$ |
| Tetrachlorophthalic anhydride | 170 mg/m$^2$ |
| Matting agent: monodipsersed silica at a degree of monodispersion of 10 percent and an average particle size of 4 μm | 70 mg/m$^2$ |
| $C_9H_{19}$—$C_6H_4$—$SO_3Na$ | 10 mg/m$^2$ |

<Preparation of Die Coater>

The slide type die coaters shown in FIG. 1 were prepared employing the method below and designated as 1-1-1-11. When prepared as shown in Table 1, the portion in contact with a liquid coating composition of each of the width 1,500 mm wide stainless steel (SUS 630) bars which constituted the slide type die coater, was covered with a fluorine based resin. These bars were arranged, whereby a slide type die coater was prepared.

Sensitizing Dye 1

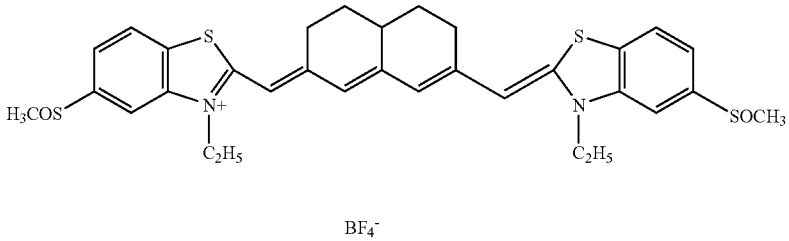

Antifogging Agent 1

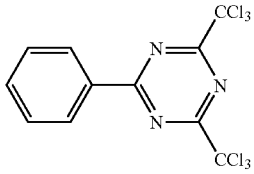

Developing Agent 1

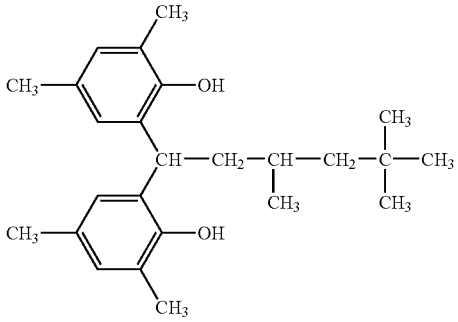

<Surface Protective Layer Liquid Coating Composition>

<<Preparation of Surface Protective Layer Liquid Coating Composition>>

| | |
|---|---|
| Acetone | 35 ml/m$^2$ |
| Methyl ethyl ketone | 17 ml/m$^2$ |
| Cellulose acetate | 2.3 g/m$^2$ |
| Methanol | 7 ml/m$^2$ |
| Phthalazine | 250 mg/m$^2$ |
| 4-methylphthalic acid | 180 mg/m$^2$ |

During the preparation, the thickness of the covered layer employing various types of the fluorine based resins was adjusted to 100 μm, and cleaning the surface to be covered with the fluorine based resins, and the baking process was carried out at the temperatures shown in Table 1. After the covering process employing the fluorine based resin, a finishing grinding process was performed, whereby the straightness shown in Table 1 was achieved. The grinding process was performed employing a precision column type horizontal grinder, manufactured by Okamoto Machine Tool Works, Ltd.

Straightness was determined as follows. A commercially available laser displacement sensor was fixed to a grindstone holder of the grinder employing a magnet stand and the bar which was installed on the grinder to be parallel to the moving direction was linearly moved, and displacements in the horizontal direction on the vertical plane were determined across the total length of the bar, and the differences between the maximum value and the minimal value at every 1 m of the length of the bar were recorded.

The thickness of fluorine based resin was determined employing an electrostatic capacity type micro-displacement detector, manufactured by Ono Sokki Co., Ltd. The portion covered by the fluorine based resin are referred to by the same designation as the die coater on which when the above bars are mounted.

TABLE 1

| Die Coater No. | Fluorine Based Resin | Cleaning and Baking Temperature (° C.) | Straightness of Bar after Final Grinding (μm) | Portion Covered with Fluorine Based Resin: Interior Wall of Pocket Section | Interior Wall of Slit Section | Slide Plane | Lip section and Edge Section | Exterior Wall Surface Connected to Lip Section |
|---|---|---|---|---|---|---|---|---|
| 1-1 | PTFE | 450 | 2.0 | covered | covered | covered | covered | covered |
| 1-2 | PTFE | 450 | 2.0 | covered | covered | covered | covered | not covered |
| 1-3 | PTFE | 450 | 2.0 | covered | covered | covered | not covered | not covered |
| 1-4 | PTFE | 450 | 2.0 | covered | covered | not covered | not covered | not covered |
| 1-5 | PTFE | 450 | 2.0 | covered | not covered | not covered | not covered | not covered |
| 1-6 | PTFE | 450 | 0.08 | covered | covered | covered | covered | covered |
| 1-7 | PTFE | 450 | 0.10 | covered | covered | covered | covered | covered |
| 1-8 | PTFE | 450 | 1.0 | covered | covered | covered | covered | covered |
| 1-9 | PTFE | 450 | 5.0 | covered | covered | covered | covered | covered |
| 1-10 | PTFE | 450 | 10.0 | covered | covered | covered | covered | covered |
| 1-11 | PTFE | 450 | 11.0 | covered | covered | covered | covered | covered |

<Coating>

Viscosity μ (Pa·s) of the light-sensitive layer liquid coating composition prepared as above was adjusted to approximately 0.5 Pa·s, while viscosity μ (Pa·s) of the protective layer liquid coating composition was adjusted to approximately 1.0 Pa·s. Subsequently, the resulting liquid coating compositions were applied onto a support which was prepared by connecting 10 belt shaped supports (comprised of PET) at a thickness of 175 μm and a width of 1,500 mm at a coating rate of 30 m/minute, employing each of the coating devices provided with each of the slide type die coaters 1-1-1-24, so that a light-sensitive layer was arranged as a lower layer at a coated weight of 75 g/m$^2$ (being a wet coated weight), and the protective layer was arranged as an upper layer at a coated weight of 25 g/m$^2$ (being a wet coated weight), and the resulting coating was dried, whereby Samples 101-112 were prepared. Viscosity was determined employing ROTOVISCO RV-12 of Haake, Inc. and viscosity at each shearing was determined.

Pipes covered with a fluorine based resin (PTFE) were employed in the liquid coating composition feeding channel section.

<Evaluation>

Table 2 shows the measurement results of the coating layer thickness distribution in the lateral direction of each of prepared Samples 101-111. The coating layer thickness distribution in the lateral direction was evaluated based on the evaluation rankings described below. Incidentally, the coating layer thickness distribution in the lateral direction was obtained as follows. The coating layer thickness at the end of the coating was recorded at an interval of 50 mm across the width, and the ratio of the difference between the maximum value and the minimum value to the average value was calculated and expressed as a percentage. The coating layer thickness was determined as follows, while employing an electrical micrometer MINICOM M, manufactured by Tokyo Seimitsu Co., Ltd. Total thickness at one point of a sample was measured. Thereafter, the coating layer of the same point was dampened with methyl ethyl ketone and removed employing nonwoven fabric, whereby the thickness of the support was determined. The difference between these values was designated as the coated layer thickness.

Evaluation rankings for the coating layer thickness distribution in the lateral direction A: coating layer thickness distribution in the lateral direction was 0.1-1.0 percent B: coating layer thickness distribution in the lateral direction was 1.1-2.5 percent C: coating layer thickness distribution in the lateral direction was 2.6-5.0 percent D: coating layer thickness distribution in the lateral direction was 5.1-9.9 percent E: coating layer thickness distribution in the lateral direction was at least 10 percent

TABLE 2

| Sample No. | Die Coater No. | Coating Layer Thickness Distribution in the Lateral Direction |
|---|---|---|
| 101 | 1-1 | A |
| 102 | 1-2 | A |
| 103 | 1-3 | A |
| 104 | 1-4 | A |
| 105 | 1-5 | A |
| 106 | 1-6 | A |
| 107 | 1-7 | A |
| 108 | 1-8 | A |
| 109 | 1-9 | A |
| 110 | 1-10 | B |
| 111 | 1-11 | E |

By controlling the straightness to be 0.1-10 μm after performing the covering treatment employing fluorine based resins, the layer thickness distribution in the lateral direction was improved and at the same time, the die coater was not stained after coating, whereby the usefulness of the present invention was confirmed. Incidentally, Sample No. 106 exhibited the desired layer thickness distribution in the lateral direction. However, since in order to realize the straightness of bars, excessive time, man-hours, and cost were required, it was judged that its realization was too difficult.

Example 2

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

<Preparation of Die Coater>

The slide type die coaters shown in FIG. 1 were prepared employing the method below and designated as 2-1-2-17. During the preparation, the portion in contact with a liquid coating composition of each of the 1,500 mm wide stainless steel (SUS 630) bars which constituted the slide type die coater, was covered with a fluorine based resin. After the baking treatment, the portion covered with the fluorine based resin was polished and bars at a varying surface roughness as shown in Table 3 were prepared. These bars were arranged, whereby a slide type die coater was prepared.

During the preparation, cleaning the surface to be covered with the fluorine based resin was carried out at 450° C., and a baking treatment to facilitate adhering the fluorine based resin to the bar was carried out at 400° C. Employed as a fluorine based resin was PTFE and the thickness of the fluorine resin was set at 100 μm.

The thickness of the fluorine based resin was determined employing the same method as for Example 1. The polishing process was manually performed employing PIKAL Metal Abrasive, manufactured by Nippon Maryo Kogyo Co., Ltd. Surface roughness Ra and Rmax were determined employing Surftest SJ-201P, manufactured by Mitsutoyo, Ltd.

TABLE 3

| Die Coater | Roughness of Surface Covered with Fluorine Based Resin | | Portion Covered with Fluorine Resin | | | | |
|---|---|---|---|---|---|---|---|
| | | | Interior Wall of Pocket | Interior Wall of Slit | Slide | Lip Section and Edge | Exterior Wall Surface Connected to |
| No. | Ra (μm) | Rmax | Section | Section | Plane | Section | Lip Section |
| 2-1 | 0.008 | 0.1 | covered | covered | covered | covered | covered |
| 2-2 | 0.01 | 0.1 | covered | covered | covered | covered | covered |
| 2-3 | 0.06 | 0.1 | covered | covered | covered | covered | covered |
| 2-4 | 0.1 | 3.0 | covered | covered | covered | covered | covered |
| 2-5 | 0.5 | 3.0 | covered | covered | covered | covered | covered |
| 2-6 | 0.8 | 5.0 | covered | covered | covered | covered | covered |
| 2-7 | 1.0 | 5.0 | covered | covered | covered | covered | covered |
| 2-8 | 1.1 | 5.0 | covered | covered | covered | covered | covered |
| 2-9 | 0.01 | 0.09 | covered | covered | covered | covered | covered |
| 2-10 | 0.01 | 0.1 | covered | covered | covered | covered | covered |
| 2-11 | 0.01 | 0.3 | covered | covered | covered | covered | covered |
| 2-12 | 0.7 | 0.5 | covered | covered | covered | covered | covered |
| 2-13 | 0.7 | 1.0 | covered | covered | covered | covered | covered |
| 2-14 | 0.7 | 2.0 | covered | covered | covered | covered | covered |
| 2-15 | 1.0 | 4.0 | covered | covered | covered | covered | covered |
| 2-16 | 1.0 | 5.0 | covered | covered | covered | covered | covered |
| 2-17 | 1.0 | 5.2 | covered | covered | covered | covered | covered |

<Coating>

Coating and drying were carried out employing a coating apparatus mounted with each of slide type die coaters 2-1-2-17 under the same condition as for Example 1, and the resulting coatings were designated as Samples 201-217. The liquid coating composition feeding channel section employed pipes which were covered with a fluorine based resin (PTFE).

<Evaluation>

After drying, the number of streaks on each of resulting Samples 2-1-2-17 was visually recorded over the total length. Table 4 shows the results.

TABLE 4

| Sample No. | Die Coater No. | Number of Streaking Problems |
|---|---|---|
| 201 | 2-1 | 0 |
| 202 | 2-2 | 0 |
| 203 | 2-3 | 1 |
| 204 | 2-4 | 1 |
| 205 | 2-5 | 2 |
| 206 | 2-6 | 2 |
| 207 | 2-7 | 5 |
| 208 | 2-8 | 13 |
| 209 | 2-9 | 0 |
| 210 | 2-10 | 0 |
| 211 | 2-11 | 0 |
| 212 | 2-12 | 1 |
| 213 | 2-13 | 1 |
| 214 | 2-14 | 2 |
| 215 | 2-15 | 3 |
| 216 | 2-16 | 5 |
| 217 | 2-17 | 15 |

By controlling the surface roughness of the portion covered with fluorine based resin to be 0.01 μm≦Ra<1 μm, as well as 0.1 μm<Rmax<5 μm, generation of streaks decreased, whereby the usefulness of the present invention Example 3

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

in Table 5 were prepared. These bars were arranged, whereby a slide type die coater was prepared.

During the preparation, cleaning the surface to be covered with the fluorine based resin was carried out at 450° C., and a baking treatment to facilitate adhering the fluorine based resins to the die coater was carried out at 400° C. Employed as a fluorine based resin was PTFE and the thickness of the fluorine resin was set at 100 μm.

Final grinding and polishing were performed employing the same method as for Example 1. The straightness, thickness of the fluorine resins, and surface roughness Ra and Rmax were determined employing the same methods as for Example 1.

TABLE 5

| Die Coater No. | Straightness of Surface Covered with Fluorine Based Resin (μm) | Roughness of Surface Covered with Fluorine Based Resin Ra (μm) | Rmax | Portion Covered with Fluorine Based Resin: Interior Wall of Pocket Section | Interior Wall of Slit Section | Slide Plane | Lip Section and Edge Section | Exterior Wall Surface Connected to Lip Section |
|---|---|---|---|---|---|---|---|---|
| 3-1 | 3.0 | 0.008 | 0.1 | covered | covered | covered | covered | covered |
| 3-2 | 3.0 | 0.01 | 0.1 | covered | covered | covered | covered | covered |
| 3-3 | 3.0 | 0.06 | 0.1 | covered | covered | covered | covered | covered |
| 3-4 | 3.0 | 0.1 | 3.0 | covered | covered | covered | covered | covered |
| 3-5 | 3.0 | 0.5 | 3.0 | covered | covered | covered | covered | covered |
| 3-6 | 3.0 | 0.8 | 5.0 | covered | covered | covered | covered | covered |
| 3-7 | 3.0 | 1.0 | 5.0 | covered | covered | covered | covered | covered |
| 3-8 | 3.0 | 1.1 | 5.0 | covered | covered | covered | covered | covered |
| 3-9 | 3.0 | 0.01 | 0.09 | covered | covered | covered | covered | covered |
| 3-10 | 3.0 | 0.01 | 0.1 | covered | covered | covered | covered | covered |
| 3-11 | 3.0 | 0.01 | 0.3 | covered | covered | covered | covered | covered |
| 3-12 | 3.0 | 0.7 | 0.5 | covered | covered | covered | covered | covered |
| 3-13 | 3.0 | 0.7 | 1.0 | covered | covered | covered | covered | covered |
| 3-14 | 3.0 | 0.7 | 2.0 | covered | covered | covered | covered | covered |
| 3-15 | 3.0 | 1.0 | 4.0 | covered | covered | covered | covered | covered |
| 3-16 | 3.0 | 1.0 | 5.0 | covered | covered | covered | covered | covered |
| 3-17 | 3.0 | 1.0 | 5.2 | covered | covered | covered | covered | covered |
| 3-18 | 0.08 | 0.5 | 3.0 | covered | covered | covered | covered | covered |
| 3-19 | 0.1 | 0.5 | 3.0 | covered | covered | covered | covered | covered |
| 3-20 | 0.5 | 0.5 | 3.0 | covered | covered | covered | covered | covered |
| 3-21 | 1.0 | 0.5 | 3.0 | covered | covered | covered | covered | covered |
| 3-22 | 5.0 | 0.5 | 3.0 | covered | covered | covered | covered | covered |
| 3-23 | 8.0 | 0.5 | 3.0 | covered | covered | covered | covered | covered |
| 3-24 | 10.0 | 0.5 | 3.0 | covered | covered | covered | covered | covered |
| 3-25 | 11.0 | 0.5 | 3.0 | covered | covered | covered | covered | covered |

<Preparation of Die Coater>

The slide type die coaters shown in FIG. 1 were prepared employing the method below and designated as 3-1-3-25. During the preparation, 1,500 mm wide stainless steel (SUS 630) bars which constituted the slide type die coater were subjected to a subbing treatment and a cleaning treatment by a thermal process. Thereafter, the portions in contact with a liquid coating composition were covered with the fluorine based resin. After the baking treatment, the portions covered with the fluorine based resin were subjected to grinding and polishing and bars at a varying surface roughness as shown <Coating>

Samples 301-325 were prepared employing the coating apparatus mounted with each of slide type die coaters 3-1-3-25, while coated and dried under the same conditions as for Example 1. However, the liquid coating composition feeding channel section employed pipes which were covered with a fluorine based resin (PTFE).

<Evaluation>

The coating layer thickness distribution in the lateral direction and the number of resulting streaks on Samples 301-325 were determined. Table 6 shows the results. Incidentally, the coating layer thickness distribution in the lateral direction was determined employing the same method as for Example 1 and evaluated employing the same rankings as for Example 1. The number of streaks was determined employing the same method as for Example 2.

TABLE 6

| Sample No. | Die Coater No. | Number of Streaking Problems | Coating Layer Thickness Distribution in the Lateral Direction |
|---|---|---|---|
| 301 | 3-1 | 0 | A |
| 302 | 3-2 | 0 | A |
| 303 | 3-3 | 0 | A |
| 304 | 3-4 | 1 | A |
| 305 | 3-5 | 2 | A |
| 306 | 3-6 | 3 | A |
| 307 | 3-7 | 5 | A |
| 308 | 3-8 | 15 | A |
| 309 | 3-9 | 0 | A |
| 310 | 3-10 | 0 | A |
| 311 | 3-11 | 1 | A |
| 312 | 3-12 | 2 | A |
| 313 | 3-13 | 2 | A |
| 314 | 3-14 | 3 | A |
| 315 | 3-15 | 3 | A |
| 316 | 3-16 | 5 | A |
| 317 | 3-17 | 18 | A |
| 318 | 3-18 | 2 | A |
| 319 | 3-19 | 2 | A |
| 320 | 3-20 | 1 | A |
| 321 | 3-21 | 2 | A |
| 322 | 3-22 | 3 | A |
| 323 | 3-23 | 2 | B |
| 324 | 3-24 | 2 | B |
| 325 | 3-25 | 1 | C |

After carrying out the thermal treatment to clean the surface to be covered with the fluorine based resin and the baking treatment to facilitate adhering the fluorine based resin to the bars, the straightness and the surface roughness were controlled to be in the range specified by the present invention, whereby the layer thickness distribution in the lateral direction was improved and the formation of streaks was minimized, whereby the usefulness of the present invention was confirmed. Incidentally, Sample Nos. 301, 309, and 318 exhibited the desired layer thickness distribution in the lateral direction. However, since in order to realize the surface roughness and straightness of bars, excessive time, man-hours, and cost were required, it was judged that its realization was too difficult.

Example 4

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

<Preparation of Die Coater>

The extrusion type die coaters shown in FIG. 2 were prepared employing the method below and designated as 4-1-4-11. During the preparation, the portion in contact with liquid coating compositions of the 1,500 mm wide stainless steel (SUS 630) bars of a which constituted the extrusion type die coater was covered with a fluorine based resin. These bars were arranged, whereby an extrusion type die coater was prepared.

During the preparation, the thickness of the covered layer comprised of various fluorine based resins shown in Table 7 was set at 100 μm, and cleaning the surface to be covered with the fluorine based resin and the baking process were performed at the temperatures shown in Table 7. After covering employing the fluorine based resin, final grinding was performed to achieve the straightness shown in Table 7. Further, the portions covered with the fluorine based resin were polished to result in surface roughness Ra of 0.1 μm and Rmax of 0.5 μm.

The grinding process was performed employing the same method as for Example 1. The straightness, thickness of the fluorine resin, and surface roughness Ra and Rmax were determined employing the same methods as for Example 1. The portions covered with the fluorine resin were referred to by the same designation as the die coater on which the above portion was mounted.

TABLE 7

| | | | | Portion Covered with Fluorine Resin | | | | |
|---|---|---|---|---|---|---|---|---|
| Die Coater No. | Fluorine Based Resin | Cleaning and Baking Temperature (° C.) | Straightness of Bar after Final Grinding (μm) | Interior Wall of Pocket Section | Interior Wall of Slit Section | Slide Plane | Lip Section and Edge Section | Exterior Wall Surface Connected to Lip Section |
| 4-1 | PTFE | 450 | 2.0 | covered | covered | covered | covered | covered |
| 4-2 | PTFE | 450 | 2.0 | covered | covered | covered | covered | not covered |
| 4-3 | PTFE | 450 | 2.0 | covered | covered | covered | not covered | not covered |
| 4-4 | PTFE | 450 | 2.0 | covered | covered | not covered | not covered | not covered |
| 4-5 | PTFE | 450 | 2.0 | covered | not covered | not covered | not covered | not covered |
| 4-6 | PTFE | 450 | 0.08 | covered | covered | covered | covered | covered |
| 4-7 | PTFE | 450 | 0.1 | covered | covered | covered | covered | covered |
| 4-8 | PTFE | 450 | 1.0 | covered | covered | covered | covered | covered |
| 4-9 | PTFE | 450 | 5.0 | covered | covered | covered | covered | covered |
| 4-10 | PTFE | 450 | 10.0 | covered | covered | covered | covered | covered |
| 4-11 | PTFE | 450 | 11.0 | covered | covered | covered | covered | covered |

<Coating>

Samples 401-411 were prepared employing the coating apparatus mounted with each of extrusion type die coaters

4-1-4-11 as prepared above, while coated and dried under the same conditions as for Example 1. However, liquid coating composition feeding channel section employed pipes which were covered with a fluorine based resin (PTFE).

<Evaluation>

The coating layer thickness distribution in the lateral direction of each of resulting Samples 401-411 was determined employing the same method as for Example 1 and evaluated employing the same evaluation rankings as for Example 1. Table 8 shows the results.

TABLE 8

| Sample No. | Die Coater No. | Coating Layer Thickness Distribution in the Lateral Direction |
|---|---|---|
| 401 | 4-1 | A |
| 402 | 4-2 | A |
| 403 | 4-3 | A |
| 404 | 4-4 | A |
| 405 | 4-5 | A |
| 406 | 4-6 | A |
| 407 | 4-7 | A |
| 408 | 4-8 | A |
| 409 | 4-9 | A |
| 410 | 4-10 | B |
| 411 | 4-11 | E |

It was confirmed that even though the bars which constituted the slide type die coater were replaced with bars which constituted the extrusion type die coater, the resulting effects were the same as for bars constituting the slide type die coater, whereby the usefulness of the present invention was confirmed. Incidentally, Sample No. 706 exhibited the desired layer thickness distribution in the lateral direction. However, since in order to realize the straightness of the bar, excessive time, man-hours, and cost were required, it was judged that its realization was too difficult.

Example 5

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

<Preparation of Die Coater>

The slide type die coaters shown in FIG. 1 were prepared employing the method below. The portion in contact with liquid coating compositions of the 1,500 mm wide stainless steel (SUS 630) bars of which constituted the slide type die coater was subjected to a thermal pretreatment at various temperatures as shown in Table 3 before the above portion was covered with the fluorine based resin. Any resulting distortion was removed by grinding. Thereafter, the bars which had been subjected to final polishing was mounted, whereby slide type die coaters were prepared and designated as 5-1-5-22. Further, slide type die coaters which were mounted with bars which had not been subjected to grinding were prepared and designated as 5-23 and 5-24. Incidentally, for comparison, bars were prepared in such a manner that without the thermal pretreatment, bars were covered with different types of fluorine based resins and were subjected to grinding. Each of the these resulting bars was mounted and slide type die coaters designated as 5-25 and 5-26 were prepared.

During the preparation, the thickness of the covered layer comprised of various fluorine based resins shown in Table 9 was set at 100 μm, and cleaning the surface to be covered with the fluorine based resin and the baking process were performed at the temperatures shown in Table 7. After covering with the fluorine based resin, final grinding was performed to reach the straightness shown in Table 9. Further, the portions covered with the fluorine based resin were polished to result in surface roughness Ra of 0.1 μm and Rmax of 0.5 μm.

The grinding process was performed employing the same method as for Example 1. The Straightness, thickness of the fluorine resin, and surface roughness Ra and Rmax were determined employing the same methods as for Example 1. The portion covered with the fluorine resin was referred to by the same designation as the die coater on which the above portion was mounted. Incidentally, each of die coaters 5-1-5-26 was stored at normal temperature for one year and then employed.

TABLE 9

| | | | | | Portion Covered with Fluorine Based Resin | | | | |
|---|---|---|---|---|---|---|---|---|---|
| Die Coater No. | Fluorine Based Resin | Cleaning and Baking Temperature (° C.) | Thermal Pretreatment Temperature (° C.) | Straightness of Bar after Final Grinding (μm) | Interior Wall of Pocket Section | Interior Wall of Slit Section | Slide Plane | Lip Section and Edge Section | Exterior Wall Surface Connected to Lip Section |
| 5-1 | PTFE | 450 | 1000 | 2.0 | covered | covered | covered | covered | covered |
| 5-2 | PTFE | 450 | 1000 | 2.0 | covered | covered | covered | covered | not covered |
| 5-3 | PTFE | 450 | 1000 | 2.0 | covered | covered | covered | not covered | not covered |
| 5-4 | PTFE | 450 | 1000 | 2.0 | covered | covered | not covered | not covered | not covered |
| 5-5 | PTFE | 450 | 1000 | 2.0 | covered | not covered | not covered | not covered | not covered |
| 5-6 | PTFE | 450 | 750 | 2.0 | covered | covered | covered | covered | covered |
| 5-7 | PTFE | 450 | 500 | 2.0 | covered | covered | covered | covered | covered |
| 5-8 | PTFE | 450 | 450 | 2.0 | covered | covered | covered | covered | covered |
| 5-9 | PTFE | 450 | 400 | 2.0 | covered | covered | covered | covered | covered |
| 5-10 | PTFE | 450 | 250 | 2.0 | covered | covered | covered | covered | covered |

TABLE 9-continued

| Die Coater No. | Fluorine Based Resin | Cleaning and Baking Temperature (° C.) | Thermal Pretreatment Temperature (° C.) | Straightness of Bar after Final Grinding (μm) | Portion Covered with Fluorine Based Resin: Interior Wall of Pocket Section | Interior Wall of Slit Section | Slide Plane | Lip Section and Edge Section | Exterior Wall Surface Connected to Lip Section |
|---|---|---|---|---|---|---|---|---|---|
| 5-11 | PTFE | 450 | 450 | 0.08 | covered | covered | covered | covered | covered |
| 5-12 | PTFE | 450 | 450 | 0.1 | covered | covered | covered | covered | covered |
| 5-13 | PTFE | 450 | 450 | 1.0 | covered | covered | covered | covered | covered |
| 5-14 | PTFE | 450 | 450 | 5.0 | covered | covered | covered | covered | covered |
| 5-15 | PTFE | 450 | 450 | 10.0 | covered | covered | covered | covered | covered |
| 5-16 | PTFE | 450 | 450 | 11.0 | covered | covered | covered | covered | covered |
| 5-17 | PFA | 400 | 750 | 2.0 | covered | covered | covered | covered | covered |
| 5-18 | PFA | 400 | 500 | 2.0 | covered | covered | covered | covered | covered |
| 5-19 | PFA | 400 | 450 | 2.0 | covered | covered | covered | covered | covered |
| 5-20 | PFA | 400 | 400 | 2.0 | covered | covered | covered | covered | covered |
| 5-21 | PFA | 400 | 350 | 2.0 | covered | covered | covered | covered | covered |
| 5-22 | PFA | 400 | 200 | 2.0 | covered | covered | covered | covered | covered |
| 5-23 | PFA | 400 | 400 | 9.5 | covered | covered | covered | covered | covered |
| 5-24 | PTFE | 450 | 450 | 12.0 | covered | covered | covered | covered | covered |
| 5-25 | PFA | 400 | — | 2.0 | covered | covered | covered | covered | covered |
| 5-26 | PTFE | 450 | — | 2.0 | covered | covered | covered | covered | covered |

<Coating>

Viscosity μ (Pa·s) of the light-sensitive layer liquid coating composition prepared as above was adjusted to approximately 0.5 Pa·s, while viscosity μ (Pa·s) of the protective layer liquid coating composition was adjusted to approximately 1.0 Pa·s. Subsequently, the resulting liquid coating compositions were applied onto a support which was prepared by connecting 10 belt shaped supports (comprised of PET) at a thickness of 175 μm and a width of 1,500 mm at a coating rate of 30 m/minute, employing each of the coating devices provided with each of the slide type die coaters 1-1-1-24, so that the light-sensitive layer was arranged as a lower layer at a coated weight of 75 g/m$^2$ (a wet coated weight), and the protective layer was arranged as an upper layer at a coated weight of 25 g/m$^2$ (a wet coated weight), and the resulting coating was dried, whereby Samples 101-112 were prepared. Viscosity was determined employing ROTOVISCO RV-12 of Haake, Inc. and viscosity at each shearing was determined. The pipes covered with a fluorine based resin (PTFE) were employed in a liquid coating composition feeding channel section.

<Evaluation>

The coating layer thickness distribution in the lateral direction of each of resulting Samples 501-526 was determined employing the same method as for Example 1, and evaluated employing the same evaluation rankings as for Example 1. Table 10 shows the results.

TABLE 10

| Sample No. | Die Coater No. | Coating Layer Thickness Distribution in the Lateral Direction |
|---|---|---|
| 501 | 5-1 | A |
| 502 | 5-2 | A |
| 503 | 5-3 | A |
| 504 | 5-4 | A |
| 505 | 5-5 | A |
| 506 | 5-6 | A |
| 507 | 5-7 | A |
| 508 | 5-8 | B |
| 509 | 5-9 | D |
| 510 | 5-10 | E |

TABLE 10-continued

| Sample No. | Die Coater No. | Coating Layer Thickness Distribution in the Lateral Direction |
|---|---|---|
| 511 | 5-11 | A |
| 512 | 5-12 | A |
| 513 | 5-13 | A |
| 514 | 5-14 | A |
| 515 | 5-15 | A |
| 516 | 5-16 | B |
| 517 | 5-17 | A |
| 518 | 5-18 | A |
| 519 | 5-19 | A |
| 520 | 5-20 | B |
| 521 | 5-21 | D |
| 522 | 5-22 | E |
| 523 | 5-23 | B |
| 524 | 5-24 | B |
| 525 | 5-25 | E |
| 526 | 5-26 | E |

A thermal pretreatment was performed at a temperature equal to or higher than the thermal treatment temperature for cleaning the surface to be covered with the fluorine based resin and the baking treatment temperature to facilitate adhering of the fluorine based resin to the bar, and grinding was performed to remove any distortions generated by the thermal pretreatment. As a result, the layer thickness distribution in the lateral direction was improved after long elapsed time, whereby the usefulness of the present invention was confirmed. Incidentally, Sample No. 511 exhibited the desired layer thickness distribution in the lateral direction. However, since in order to realize the straightness of the bar, excessive time, man-hours, and cost were required, it was judged that its realization was too difficult. Sample Nos. 523 and 524 were subjected to grinding to remove any distortions generated after the thermal pretreatment, and covered with the fluorine based resin, but were not subjected to grinding. As a result, the straightness of the bar was inferior immediately after preparation. However, since the straightness was not degraded even after one year of storage, the layer thickness distribution in the lateral direction after suck a long time was improved. On the other hand, Sample Nos. 525 and 526 were covered with the fluorine based resin without the thermal pretreatment, and were subjected to final grinding. As a result, the straightness was degraded after the one year storage, and the layer thickness distribution in the lateral direction was not improved.

Example 6

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

<Preparation of Die Coater>

The slide type die coaters shown in FIG. 1 were prepared employing the method below and designated as 6-1-6-13. Before the portion in contact with liquid coating compositions of each of the 1,500 mm wide stainless steel (SUS 630) bars which constituted the slide type die coater was covered with the fluorine based resin, a thermal pre-treatment was performed at 500° C., and subsequently, grinding was carried out to remove any resulting distortion. Thereafter, the surface was covered with the fluorine based resin, and a baking process was performed. Thereafter, the portion covered with the fluorine based resin was polished, whereby bars were prepared in which the surface roughness was varied as shown in Table 11. Subsequently, these bars were arranged, whereby a slide type die coater was prepared. During the preparation, cleaning the surface to be covered with the fluorine based resin was carried out at 450° C., while a baking treatment to facilitate adhering the fluorine based resin to the bar was carried out at 400° C. Employed as a fluorine based resin was PTFE, and the thickness of the fluorine resin was set at 100 μm.

The thickness of the fluorine based resin was determined employing the same method as for Example 1. Polishing was performed employing the same method as for Example 2. Surface roughness Ra and Rmax were determined employing the same methods as for Example 2. Incidentally, each of die coaters 6-1-6-13 was stored for one year and then employed.

TABLE 11

| Die Coater | Roughness of Surface Covered with Fluorine Based Resin | | Portion Covered with Fluorine Based Resin | | | | |
|---|---|---|---|---|---|---|---|
| | | | Interior Wall of Pocket | Interior Wall of Slit | Slide | Lip Section and Edge | Exterior Wall Surface Connected to |
| No. | Ra (μm) | Rmax | Section | Section | Plane | Section | Lip Section |
| 6-1 | 0.01 | 0.1 | covered | covered | covered | covered | covered |
| 6-2 | 0.06 | 0.1 | covered | covered | covered | covered | covered |
| 6-3 | 0.1 | 3.0 | covered | covered | covered | covered | covered |
| 6-4 | 0.5 | 3.0 | covered | covered | covered | covered | covered |
| 6-5 | 0.8 | 5.0 | covered | covered | covered | covered | covered |
| 6-6 | 1.0 | 5.0 | covered | covered | covered | covered | covered |
| 6-7 | 0.01 | 0.1 | covered | covered | covered | covered | covered |
| 6-8 | 0.01 | 0.3 | covered | covered | covered | covered | covered |
| 6-9 | 0.7 | 0.5 | covered | covered | covered | covered | covered |
| 6-10 | 0.7 | 1.0 | covered | covered | covered | covered | covered |
| 6-11 | 0.7 | 2.0 | covered | covered | covered | covered | covered |
| 6-12 | 1.0 | 4.0 | covered | covered | covered | covered | covered |
| 6-13 | 1.0 | 5.0 | covered | covered | covered | covered | covered |

<Coating>

Samples 601-613 were prepared employing a coating apparatus mounted with each of slide die coaters 6-1-6-13, which had been stored for one year after coating, and dried under the same condition as for Example 1. However, the liquid coating composition feeding channel section employed pipes which were covered with a fluorine based resin (PTFE).

<Evaluation>

The coating layer thickness distribution in the lateral direction and the number of streaks on each of resulting Samples 601-613 were visually observed for the entire length of each sample after coating and drying. Table 12 shows the results. Incidentally, the coated layer thickness distribution was determined employing the same methods as for Example 1 and evaluated employing the same rankings as for Example 1.

TABLE 12

| Sample No. | Die Coater No. | Number of Streaking Problems | Coating Layer Thickness Distribution in the Lateral Direction |
|---|---|---|---|
| 601 | 6-1 | 0 | B |
| 602 | 6-2 | 0 | B |
| 603 | 6-3 | 1 | B |
| 604 | 6-4 | 2 | B |
| 605 | 6-5 | 2 | B |
| 606 | 6-6 | 3 | B |
| 607 | 6-7 | 0 | B |
| 608 | 6-8 | 1 | B |
| 609 | 6-9 | 1 | B |
| 610 | 6-10 | 2 | B |
| 611 | 6-11 | 2 | B |
| 612 | 6-12 | 2 | B |
| 613 | 6-13 | 4 | B |

By performing the thermal pretreatment at a higher temperature than the fluorine based resin covering thermal treatment temperature, and performing grinding to remove any resulting distortion, and polishing the portion covered with the fluorine based resin, the surface roughness of the portion covered with the fluorine based resin was controlled to be 0.01 μm<Ra<1 μm, as well as 0.1 μm<Rmax<5 μm. As a result, the coating layer thickness distribution in the lateral direction was improved as desired, after a long time since the preparation of the die coater and the number of streaks decreased, whereby the usefulness of the present invention was confirmed.

Example 7

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

TABLE 13

| Die Coater No. | Straightness of Surface Covered with Fluorine Based Resin (μm) | Roughness of Surface Covered with Fluorine Based Resin Ra (μm) | Rmax | Portion Covered with Fluorine Based Resin: Interior Wall of Pocket Section | Interior Wall of Slit Section | Slide Plane | Lip Section and Edge Section | Exterior Wall Surface Connected to Lip Section |
|---|---|---|---|---|---|---|---|---|
| 7-1 | 3.0 | 0.01 | 0.1 | covered | covered | covered | covered | covered |
| 7-2 | 3.0 | 0.06 | 0.1 | covered | covered | covered | covered | covered |
| 7-3 | 3.0 | 0.1 | 3.0 | covered | covered | covered | covered | covered |
| 7-4 | 3.0 | 0.5 | 3.0 | covered | covered | covered | covered | covered |
| 7-5 | 3.0 | 0.8 | 5.0 | covered | covered | covered | covered | covered |
| 7-6 | 3.0 | 1.0 | 5.0 | covered | covered | covered | covered | covered |
| 7-7 | 3.0 | 0.01 | 0.1 | covered | covered | covered | covered | covered |
| 7-8 | 3.0 | 0.01 | 0.3 | covered | covered | covered | covered | covered |
| 7-9 | 3.0 | 0.7 | 0.5 | covered | covered | covered | covered | covered |
| 7-10 | 3.0 | 0.7 | 1.0 | covered | covered | covered | covered | covered |
| 7-11 | 3.0 | 0.7 | 2.0 | covered | covered | covered | covered | covered |
| 7-12 | 3.0 | 1.0 | 4.0 | covered | covered | covered | covered | covered |
| 7-13 | 3.0 | 1.0 | 5.0 | covered | covered | covered | covered | covered |
| 7-14 | 0.1 | 0.5 | 3.0 | covered | covered | covered | covered | covered |
| 7-15 | 0.5 | 0.5 | 3.0 | covered | covered | covered | covered | covered |
| 7-16 | 1.0 | 0.5 | 3.0 | covered | covered | covered | covered | covered |
| 7-17 | 5.0 | 0.5 | 3.0 | covered | covered | covered | covered | covered |
| 7-18 | 8.0 | 0.5 | 3.0 | covered | covered | covered | covered | covered |
| 7-19 | 10.0 | 0.5 | 3.0 | covered | covered | covered | covered | covered |

<Preparation of Die Coater>

The slide type die coater shown in FIG. 1 was prepared employing the method below. Each of the 1,500 mm wide stainless steel (SUS 630) bars of which constituted the slide type die coater was subjected to a thermal pretreatment at 500° C. before the above portion was covered with the fluorine based resin. Any resulting distortion was removed by grinding. Thereafter, the portion in contact with the liquid coating composition was covered with the fluorine based resin. After a baking process, the portion covered with the fluorine resin was subjected to final grinding and polishing, whereby bars, in which the straightness and surface roughness were varied as shown in Table 13, were prepared. These bars were arranged and a slide type die coater was constituted. During the preparation, cleaning the surface covered with the fluorine resin was performed at 450° C., while a baking process to facilitate adhering of the fluorine resin to the die coater was carried out at 400° C. Employed as a fluorine based resin was PTFE, and the thickness of the fluorine resin was set at 100 μm.

The final grinding process was performed employing the same method as for Example 1. The straightness and the thickness of the fluorine resin were determined employing the same methods as for Example 1. A polishing process was carried out employing the same method as Example 2. Surface roughness Ra and Rmax were determined employing the same method as for Example 2. Incidentally, each of die coaters 7-1-7-19 was stored at normal temperature for one year and then employed.

<Coating>

Samples 701-719 were prepared employing a coating apparatus mounted with each of slide die coaters 7-1-7-19 which had been stored for one year since being coated and dried under the same condition as for Example 1. However, the liquid coating composition feeding channel section employed pipes which were covered with a fluorine based resin (PTFE).

<Evaluation>

The coating layer thickness distribution in the lateral direction and the number of streaks on each of resulting Sample 7-1-7-19 were determined. Table 14 shows the results. Incidentally, the coating layer thickness distribution in the lateral direction was determined employing the same method as for Example 1, and was evaluated employing the same rankings as for Example 1. The number of streaks was determined employing the same method as for Example 2.

TABLE 14

| Sample No. | Die Coater No. | Number of Streaking Problems | Coating Layer Thickness Distribution in the Lateral Direction |
|---|---|---|---|
| 701 | 7-1 | 0 | A |
| 702 | 7-2 | 1 | A |
| 703 | 7-3 | 1 | A |
| 704 | 7-4 | 2 | A |
| 705 | 7-5 | 3 | A |
| 706 | 7-6 | 4 | A |
| 707 | 7-7 | 0 | A |
| 708 | 7-8 | 0 | A |
| 709 | 7-9 | 1 | A |
| 710 | 7-10 | 1 | A |
| 711 | 7-11 | 2 | A |
| 712 | 7-12 | 2 | A |
| 713 | 7-13 | 3 | A |
| 714 | 7-14 | 1 | A |
| 715 | 7-15 | 2 | A |
| 716 | 7-16 | 2 | A |
| 717 | 7-17 | 1 | A |
| 718 | 7-18 | 3 | B |
| 719 | 7-19 | 1 | B |

After performing the thermal pretreatment, the thermal process to clean the surface to be covered with the fluorine based resin and the baking process to facilitate adhering the fluorine based resin to the bar were carried out., Subsequently, the covered portion was subjected to final grinding and polishing so that the straightness and the surface roughness were controlled to be in the range specified by the present invention. As a result, the layer thickness distribution in the lateral direction was further improved after a long time since the preparation of the die coater, and it was possible to perform coating showing much less streaking, whereby the usefulness of the present invention was confirmed.

Example 8

<Light-Sensitive Layer Liquid Coating Composition>

The light-sensitive layer liquid coating composition as prepared in Example 1 was employed.

<Surface Protective Layer Liquid Coating Composition>

The surface protective layer liquid coating composition as prepared in Example 1 was employed.

<Preparation of Die Coater>

The extrusion type die coaters shown in FIG. 2 were prepared employing the method below and designated as 8-1-8-24. Before the portion in contact with liquid coating compositions of each of the 1,500 mm wide stainless steel (SUS 630) bars of which constituted, the extrusion type die coater was covered with the fluorine based resin, a thermal pre-treatment was performed upon varying temperatures as shown in Table 15, and subsequently, grinding was carried out to remove ant resulting distortion. Thereafter, the surface was covered with the fluorine based resin. Then, bars which had been subjected to final grinding were arranged, whereby extrusion types were prepared and designated as 8-1 and 8-22. On the other hand, bars which had not been to final grinding were mounted, whereby extrusion type die coaters were prepared and designated as 8-23 and 8-24. Incidentally, for comparison, bars which were prepared in such a manner that without performing the thermal pretreatment, the surface was covered with various types of fluorine based resins and the final grinding was performed. The resulting bars were mounted, whereby extrusion type die coaters 8-25 and 8-26 were prepared.

During the preparation, the thickness of the covered layer comprised of various fluorine based resins shown in Table 15 was set at approximately 100 μm. Further, cleaning of the surface covered with the fluorine based resin and the baking treatment were performed at the temperatures shown in Table 15. Final grinding was carried out after covering with the fluorine resin to reach the straightness shown in Table 15.

Grinding was carried out employing the same method as for Example 1, while the straightness and thickness of the fluorine based resin were determined employing the same method as for Example 1. The portion covered with the fluorine resin was referred to by the same designation as the die coater on which the above portion was mounted. Incidentally, each of die coaters 8-1-8-26 was stored at normal temperature for one year and then employed.

TABLE 15

| | | | | | Portion Covered with Fluorine Based Resin | | | | |
|---|---|---|---|---|---|---|---|---|---|
| Die Coater No. | Fluorine Based Resin | Cleaning and Baking Temperature (° C.) | Thermal Pretreatment Temperature (° C.) | Straightness of Bar after Final Grinding (μm) | Interior Wall of Pocket Section | Interior Wall of Slit Section | Slide Plane | Lip Section and Edge Section | Exterior Wall Surface Connected to Lip Section |
| 8-1 | PTFE | 450 | 1000 | 2.0 | covered | covered | covered | covered | covered |
| 8-2 | PTFE | 450 | 1000 | 2.0 | covered | covered | covered | covered | not covered |
| 8-3 | PTFE | 450 | 1000 | 2.0 | covered | covered | covered | not covered | not covered |
| 8-4 | PTFE | 450 | 1000 | 2.0 | covered | covered | not covered | not covered | not covered |
| 8-5 | PTFE | 450 | 1000 | 2.0 | covered | not covered | not covered | not covered | not covered |
| 8-6 | PTFE | 450 | 750 | 2.0 | covered | covered | covered | covered | covered |
| 8-7 | PTFE | 450 | 500 | 2.0 | covered | covered | covered | covered | covered |
| 8-8 | PTFE | 450 | 450 | 2.0 | covered | covered | covered | covered | covered |
| 8-9 | PTFE | 450 | 400 | 2.0 | covered | covered | covered | covered | covered |
| 8-10 | PTFE | 450 | 250 | 2.0 | covered | covered | covered | covered | covered |
| 8-11 | PTFE | 450 | 450 | 0.08 | covered | covered | covered | covered | covered |
| 8-12 | PTFE | 450 | 450 | 0.10 | covered | covered | covered | covered | covered |
| 8-13 | PTFE | 450 | 450 | 1.0 | covered | covered | covered | covered | covered |
| 8-14 | PTFE | 450 | 450 | 5.0 | covered | covered | covered | covered | covered |

TABLE 15-continued

| Die Coater No. | Fluorine Based Resin | Cleaning and Baking Temperature (° C.) | Thermal Pretreatment Temperature (° C.) | Straightness of Bar after Final Grinding (μm) | Portion Covered with Fluorine Based Resin: Interior Wall of Pocket Section | Interior Wall of Slit Section | Slide Plane | Lip Section and Edge Section | Exterior Wall Surface Connected to Lip Section |
|---|---|---|---|---|---|---|---|---|---|
| 8-15 | PTFE | 450 | 450 | 10.0 | covered | covered | covered | covered | covered |
| 8-16 | PTFE | 450 | 450 | 11.0 | covered | covered | covered | covered | covered |
| 8-17 | PFA | 400 | 750 | 2.0 | covered | covered | covered | covered | covered |
| 8-18 | PFA | 400 | 500 | 2.0 | covered | covered | covered | covered | covered |
| 8-19 | PFA | 400 | 450 | 2.0 | covered | covered | covered | covered | covered |
| 8-20 | PFA | 400 | 400 | 2.0 | covered | covered | covered | covered | covered |
| 8-21 | PFA | 400 | 350 | 2.0 | covered | covered | covered | covered | covered |
| 8-22 | PFA | 400 | 200 | 2.0 | covered | covered | covered | covered | covered |
| 8-23 | PTFE | 450 | 450 | 12.0 | covered | covered | covered | covered | covered |
| 8-24 | PFA | 400 | 400 | 9.5 | covered | covered | covered | covered | covered |
| 8-25 | PTFE | 450 | — | 2.0 | covered | covered | covered | covered | covered |
| 8-26 | PFA | 400 | — | 2.0 | covered | covered | covered | covered | covered |

Samples 801-826 were prepared employing a coating apparatus mounted with each of extrusion die coaters 8-1-8-26 which had been stored for one year since coating and dried under the same conditions as for Example 1. However, the liquid coating composition feeding channel section employed pipes which were covered with a fluorine based resin (PTFE).

<Evaluation>

The coated layer thickness distribution of each of resulting Samples 801-826 was determined employing the same method as for Example 1 and evaluated employing the same rankings as for Example 1. Table 16 shows the results.

TABLE 16

| Sample No. | Die Coater No. | Coating Layer Thickness Distribution in the Lateral Direction |
|---|---|---|
| 801 | 8-1 | A |
| 802 | 8-2 | A |
| 803 | 8-3 | A |
| 804 | 8-4 | A |
| 805 | 8-5 | A |
| 806 | 8-6 | A |
| 807 | 8-7 | A |
| 808 | 8-8 | B |
| 809 | 8-9 | D |
| 810 | 8-10 | E |
| 811 | 8-11 | A |
| 812 | 8-12 | A |
| 813 | 8-13 | A |
| 814 | 8-14 | A |
| 815 | 8-15 | A |
| 816 | 8-16 | B |
| 817 | 8-17 | A |
| 818 | 8-18 | A |
| 819 | 8-19 | A |
| 820 | 8-20 | B |
| 821 | 8-21 | D |
| 822 | 8-22 | E |
| 823 | 8-23 | B |
| 824 | 8-24 | B |
| 825 | 8-25 | E |
| 826 | 8-26 | E |

It was confirmed that even though bars constituting the slide type die coater were replaced with ones constituting the extrusion type die coater, the resulting effects were the same as for bars constituting the slide type die coater described in Example 5, whereby the usefulness of the present invention was confirmed.

What is claimed is:

1. A method of producing a die coater structured with at least two bars so as to form a pocket section to extend a coating liquid in a coating width direction, a coating liquid supply port to supply a coating liquid to the pocket section, and a slit section to discharge a coating liquid from the pocket section to a material to be coated, wherein at least a part of a surface of the two bars coming in contact with a coating liquid is covered with a fluorine-based resin, the method comprising steps, sequentially in the following order, of:

a first preheating step of conducting a preheating process for a bar with a first preheating temperature same as or higher than a baking temperature of 400° C. to 450° C. in a baking process in a covering process with the fluorine-based resin so as to remove residual machining stress in the bar;

a grinding step of grinding the bar subjected to the first preheating step so as to remove deformation on the bar caused by the first preheating step;

a covering process of covering the part of the surface of the bar with the fluorine-based resin so as to form a covered section, wherein the covering process comprises sequentially a second preheating step of cleaning the bar; wherein the second preheating temperature in the second preheating step is equal to or less than the baking temperature in the baking process; a coating process of coating the fluorine-based resin on the part to form the covered section and the baking process of baking the covered section, and a finishing step of finishing the covered section so as to have a straightness of 0.1 to 10 μm in a direction along the coating width, wherein the straightness is defined by JIS B0182.

2. The method of claim 1, wherein the first preheating temperature in the first preheating step is lower than a melting point of a material of the bar.

3. The method of claim 1, wherein the finishing step comprises a grinding process.

4. The method of claim 1, wherein the finishing step comprises a polishing process.

5. The method of claim 1, wherein the finishing step finishes the covered section so as to have a surface roughness satisfying the following formulas:

$$0.01\ \mu m < Ra < 1\ \mu m \text{ and } 1\ \mu m < Rmax < 5\ \mu m.$$

6. The method of claim 1, wherein the covering step covers the covered section with the fluorine-based resin so as to make a layer thickness thicker than a predetermined layer thickness and the finishing step makes the layer thickness to be the predetermined layer thickness after the baking process.

7. The method of claim 1, wherein the grinding process removes a warp caused by the preheating process.

8. The method of claim 6, wherein the grinding process of the finishing step grinds the covered section to make a fluorine-based resin layer to be a predetermined layer thickness.

9. The method of claim 1, wherein the die coater is a die coater in which a gap distance of the slit section of the die coater at an outlet is narrower than that at an inlet and the gap distance d of the slit section at the exit satisfies the following formula:

$$d \leqq 5 \times 10^{-5}\ (m), \text{ and}$$

wherein a material to be coated is located or conveyed to come in no contact with an exit of the slit section and the die coater jets the coating liquid in a form of a film through a space from the slit section so as to coat by colliding the coating liquid with the material trough the space.

10. The method of claim 1, wherein the die coater is a slide type die coater which discharges the coating liquid from the slit section, makes the discharged coating liquid flow down along a slope continuing to an exit of the slit section and forms a bead of the coating liquid between a portion neighboring an edge of the slope and a web-shaped support being conveyed from an upstream side to an downstream side so as to coat the web-shaped support.

11. The method of claim 1, wherein the die coater is a slide type die coater which discharges the coating liquid from the slit section and makes the discharged coating liquid free fall onto a web-shaped support being conveyed from an upstream side to an downstream side so as to coat the web-shaped support.

12. The method of claim 1, wherein the die coater has a coating width of 1 m or more.

13. The method of claim 1, wherein the coating liquid is a coating liquid for a photosensitive layer containing a silver component for a heat-developing photosensitive material or a coating liquid for a non-photoreceptive protective layer.

14. The method of claim 1, wherein the covering thickness of the fluorine-based resin is 0.1 to 1.0 mm.

* * * * *